US011262161B2

(12) United States Patent
Swallow et al.

(10) Patent No.: US 11,262,161 B2
(45) Date of Patent: Mar. 1, 2022

(54) SYSTEM AND METHOD FOR ATTACHING, ROUTING AND CONCEALING CABLES ON LOAD CARRYING WEBBING

(71) Applicant: Intelligent Textiles Limited, Middlesex (GB)

(72) Inventors: Stanley Swallow, Chiswick Greater London (GB); Asha Thompson, Teddington Middlesex (GB)

(73) Assignee: Intelligent Textiles Limited

( * ) Notice: Subject to any disclaimer, the term of this patent is extended or adjusted under 35 U.S.C. 154(b) by 0 days.

(21) Appl. No.: 16/980,694

(22) PCT Filed: Dec. 19, 2019

(86) PCT No.: PCT/GB2019/053632
§ 371 (c)(1),
(2) Date: Sep. 14, 2020

(87) PCT Pub. No.: WO2020/174204
PCT Pub. Date: Sep. 3, 2020

(65) Prior Publication Data

US 2021/0018297 A1 Jan. 21, 2021

(30) Foreign Application Priority Data

Feb. 28, 2019 (GB) ..... 1902684

(51) Int. Cl.
*A45F 5/02* (2006.01)
*F41C 33/04* (2006.01)

(52) U.S. Cl.
CPC ..... *F41C 33/041* (2013.01); *A45F 5/02* (2013.01); *A45F 2200/0591* (2013.01)

(58) Field of Classification Search
CPC ..... A45F 2200/0591; A45F 5/02; Y10T 24/1498; Y10T 24/1406; B65D 63/10; B65D 63/1018
See application file for complete search history.

(56) References Cited

U.S. PATENT DOCUMENTS 8,079,503 B1 12/2011 Yeates et al.
8,297,562 B1 10/2012 Yeates et al.
(Continued)

FOREIGN PATENT DOCUMENTS

CN 204 011 961 U 12/2014
GB 2 525 210 A 10/2015
(Continued)

OTHER PUBLICATIONS

Partial International Search Report and Written Opinion, Appln. PCT/GB2019/053632, dated Apr. 28, 2020.
(Continued)

*Primary Examiner* — Corey N Skurdal
(74) *Attorney, Agent, or Firm* — Craig A. Fieschko, Esq.; DeWitt LLP

(57) ABSTRACT

A connector (10) for connection to MOLLE webbing having a plurality of MOLLE loops (18), includes an elongate body portion and first and second arrays of tabs (12) extending from the body portion arranged in laterally opposing relationship relative to one another, tabs (12) being configured for coupling to the MOLLE loops (18) so as to attach the connector to MOLLE webbing. The body portion may be substantially planar and the first and second arrays of tabs (12) are substantially co-planar with the body portion. The body portion has a width of 2.5 to 3.8 millimetres and the tabs have a pitch either individually or in a plurality thereof of 2.5 to 3.8 millimetres. The body portion may include an internal channel for receipt of a component, such as a cable, wire or tube. The connector can be fitted to a MOLLE
(Continued)

webbing by disposing the tabs below one or more loops of the MOLLE webbing, disposing a component between the connector and the substrate, whereby the component is held by and covered by the connector. The body portion can be bent, curved or folded and attached to at least one row and at least one column of the MOLLE webbing.

49 Claims, 20 Drawing Sheets

(56) References Cited

U.S. PATENT DOCUMENTS

| | | | |
|---|---|---|---|
| 8,785,778 | B2 | 7/2014 | Streeter et al. |
| 2013/0192887 | A1 | 8/2013 | Yaguchi et al. |
| 2015/0182011 | A1 | 7/2015 | Mccrone et al. |
| 2015/0335140 | A1 | 11/2015 | Cole et al. |
| 2017/0150805 | A1 | 6/2017 | Cole et al. |
| 2018/0271264 | A1 | 9/2018 | Cole et al. |

FOREIGN PATENT DOCUMENTS

| | | | |
|---|---|---|---|
| JP | 409320689 | A | 5/1996 |
| JP | H09 320689 | A | 12/1997 |
| JP | 2013 101904 | A | 5/2013 |
| WO | WO 2013/022976 | A1 | 2/2013 |

OTHER PUBLICATIONS

International Search Report and Written Opinion, Appln. PCT/GB2019/053632, dated Aug. 6, 2020.

SYSTEM AND METHOD FOR ATTACHING, ROUTING AND CONCEALING CABLES ON LOAD CARRYING WEBBING

TECHNICAL FIELD

The present invention relates to a system for and method of securely and recoverably attaching and routing cables, wires or tubing onto the outer surface of a garment or item that employs a Pouch Attachment Ladder System (PALS) or Modular Lightweight Load-carrying Equipment (MOLLE) webbing, such as a military load-carriage vest or bag.

BACKGROUND ART

Modern war fighters around the world predominantly wear load-carriage garments or armour carriers that employ a system of slots or webbing for the attachment of pouches and equipment. This system is variously known as PALS (Pouch Attachment Ladder System) or MOLLE (Modular Lightweight Load-carrying Equipment) and historically consists of horizontal rows of 25 mm or 1" wide webbing, spaced vertically 25 mm or 1" apart and sewn to the substrate garment with vertical lines of stitching at 38 mm or 1.5" intervals. This provides for a grid of webbing loops, into which vertical strips of webbing, disposed upon the mating face of a pouch, holster and the like may be interwoven to effect a secure, but recoverable attachment.

The system is described in the prior art in the US Secretary of Army, "Interlock Attaching Strap System" patent application number U.S. Pat. No. 5,724,707 A.

MOLLE or PALS has become the de-facto accessory attachment method for the vast majority of contemporary military and law-enforcement load-carriage garments.

Hereinafter, the term MOLLE is used to refer to both MOLLE and PALS. The term MOLLE webbing is used to refer to the webbing that is disposed upon the surface of an article such as a garment or bag in the aforementioned arrangement. The term MOLLE loop is used to refer to that portion of MOLLE webbing that extends between the vertical lines of stitching at a 38 mm or 1.5" interval and so forms a single pliable loop upon the surface of an article.

A more recent development in the field has been the use of die-cut or laser-cut load-carriage garments, that seek to provide an array of loops geometrically equivalent to MOLLE webbing by the use of slots or holes on the garment's outer surface. The MOLLE webbing is therefore replaced by the outer material of the garment itself, saving weight and bulk, as well as simplifying manufacture. Hereinafter, this arrangement is referred to as laser-cut MOLLE, and references to MOLLE webbing should be construed as applying equally to laser-cut MOLLE.

Modern war fighters and law enforcement personnel also carry an increasing number of electrical and electronic devices in the course of their duties, such as radios, navigation devices, computing devices, sensors, as so on. It is advantageous to interconnect these devices, such that they might share data and electrical power, sometimes termed a Personal Area Network or PAN. This is customarily achieved by the use of interconnecting cables between the various devices.

However, conventional cables suffer from a number of drawbacks when used for interconnections between body-worn devices: conventional cables can be relatively rigid, leading to protruding loops of cable that pose a risk of snagging; loose cables can easily become tangled with themselves or other cables; loose cables can interfere with opening pouches, operating equipment and donning and doffing garments; stray cables can be uncomfortable for the wearer, causing pressure points or chafing when they stray under backpack straps, for instance.

There have been attempts in the art to address these shortcomings. For instance, Streeter et al in U.S. Pat. No. 8,785,778 "PALS Compliant Routing System" disclose a system of flat cables enclosed in fabric webbing of 2.5 cm (1") width, allied with terminating connectors that are provided with clips or lips to facilitate the connectors' retention under loops of MOLLE webbing. However, while the flat cables are designed to pass through loops of MOLLE webbing when routed in a vertical fashion, no method is provided for retaining the flat cables when routed in a horizontal fashion. In this respect, the flat cables therefore offer little advantage over conventional circular-section cables. Indeed, the requirement to fold the flat cables at transitions from horizontal to vertical routing, in the absence of any retention mechanism for the horizontal portion, may exacerbate the formation of protruding loops of cable.

Some commercial products also seek to address the issue of cable retention on MOLLE equipped load-carriage. For example, Otto Engineering Inc.'s Cable Management Clip product and ITW Military Products' Web Dominator product are both devices that clip onto a single MOLLE loop and provide a recoverable fastening for a portion of cable or tubing. Both of these devices suffer the disadvantage that they occupy one MOLLE loop position which might otherwise be usable for the attachment of a pouch or other equipment. When many of these devices are employed, as might be required to anchor the entire length of a cable, many MOLLE loop positions are rendered unusable.

Examples of connector systems for MOLLE type loops have been disclosed in U.S. Pat. No. 8,297,562, US-2015/0182011, US-2013/0192887, WO-2013/022976, GB-2,525,210 and US-2012/0045929.

SUMMARY OF THE INVENTION

The present invention seeks to provide an improved system for and method of securely and recoverably attaching and routing cables, wires or tubing onto the outer surface of a garment or item that employs a PALS or MOLLE webbing, such as a military load-carriage vest or bag, and particularly to address some or all of the drawbacks of existing systems. The preferred embodiments provide a system and method by which cables may be captured, routed and concealed, in both vertical and horizontal routings, by simple and recoverable attachment to MOLLE webbing, while retaining the usability of all of this MOLLE webbing.

According to an aspect of the present invention, there is provided a connector for connection to MOLLE webbing said MOLLE webbing having a plurality of MOLLE loops, the connector including an elongate flexible strip having longitudinally extending sides and first and second arrays of tabs extending from a respective side of the strip and arranged in laterally opposing relationship relative to one another, said tabs being configured for coupling to MOLLE loops with the tabs retaining their laterally opposing relationship relative to one another, thereby to attach the connector to MOLLE webbing, the elongate flexible strip being foldable.

According to another aspect of the present invention, there is provided a connector and MOLLE webbing system having at least first and second rows of MOLLE loops, the connector including an elongate flexible strip having longitudinally extending sides and first and second arrays of tabs extending from a respective side of the strip and arranged in laterally opposing relationship relative to one another, said tabs being configured for coupling to MOLLE loops with the tabs retaining their laterally opposing relationship relative to one another, thereby so as to attach the connector to MOLLE webbing with the connector at least partially disposed and attached between the first and second rows of MOLLE loops, the elongate flexible strip being foldable.

The flexible strip is advantageously flexible so as to be foldable on itself. In practice, this enables the strip to be folded so as to change direction and is sufficiently foldable that facing folded surfaces are preferably able to touch one another. This keeps the connector flat even when folded.

Advantageously, the body portion is substantially flat. In particular, the body portion may be substantially planar and the first and second arrays of tabs substantially co-planar with the body portion.

The elongate body portion has a longitudinal dimension and the first and second arrays of tabs are preferably substantially aligned in the longitudinal dimension.

It is preferred that the tabs of the first and second arrays are of substantially the same length, although they may be of different lengths.

Advantageously, the tabs of the first and second arrays are of substantially the same lateral width, although they may be of different lateral widths. For example, the tabs of the first array may be laterally wider than the tabs of the second array.

In embodiments the tabs include at least one slit between a base of the tab and the longitudinal strip. The tabs may include first and second slits either side of the base of the tab.

The provision of such slits can assist in ensuring that the connector remains attached, or locked, to MOLLE webbing.

In some embodiments, the body portion includes one or more openings or slits for the passage of a component therethrough.

Preferably, the body portion has a width of 2.5 centimetres. Similarly, it is preferred that the tabs have a pitch either individually or in a plurality thereof of 2.5 to 3.8 centimetres.

In some embodiments, the body portion includes an internal channel for receipt of a component, which may be for the receipt of a cable, wire or tube. The component may be releasably received in the internal channel or may be fixed to the body portion in the internal channel.

The connector or system may include a coupling element disposed at least at one end of the elongate strip, the coupling element providing access to the internal channel in the strip. It may include male and female coupling elements disposed at opposite ends of the elongate strip, the coupling elements providing access to the internal channel in the strip.

The connector or system may include a fixation frame connectable between MOLLE loops and having a connector portion to which a coupling element of the strip can be releasably attached. The fixation frame preferably includes slotted feet configured to be coupled into associated MOLLE loops. The slotted feet advantageously have slots disposed orthogonally to one another. The frame is preferably rotationally symmetrical so that it can be fitted to MOLLE webbing in different orientations as disclosed below. The fixation frame may constitute an individual and distinct aspect of the invention.

In some embodiments, the body portion includes a hook or tie element on an outer surface thereof. The hook or tie element may be a cable, wire or tube hook or tie.

The connector may be transversally separable into sections having at least one set of laterally opposing tabs.

The connector or system may include an insertion tool including an interior configured to receive the flexible connector with the tabs deflected by the tool, the tool being configured to be insertable in a MOLLE loop with the elongate strip fitted in the tool, the tabs engaging with the MOLLE loop on removal of the tool.

Advantageously, the tool includes a base member and first and second upstanding flanges tapering towards one another from the base member, the flanges being configured to deflect the tabs towards one another when the strip is inserted into the tool.

The connector is most preferably sized to fit between rows of standard MOLLE webbing and/or within columns of standard MOLLE webbing loops.

According to the teachings herein, body-worn cables are provided with a series of laterally disposed, opposing pairs of flexible tabs, that are so designed as to be tucked under MOLLE loops and thus serve to anchor the cables along their lengths to the surface of a load-carriage garment in a desired routing.

In preferred embodiments, a cable is provided with opposing pairs of laterally disposed flexible tabs, the tabs of an opposing pair being spaced apart by 25 mm or 1", such that when the cable is to be routed horizontally, it may be anchored both from above and below by two adjacent rows of MOLLE webbing. The tabs may advantageously be provided as formed and/or cut from the outer material of the cable itself.

The tabs are disposed along the length of a flexible sheet or strip, such that they may be anchored horizontally between two adjacent rows of MOLLE webbing or vertically under a column of MOLLE loops, such that it forms an open-ended pocket or conduit through which a cable may be routed.

The flexible strip may be retrospectively fitted to a cable. The retrospective fitment to a cable may be achieved by means of clips, ties, flexible hook-and-loop fasteners or some other suitable cable anchoring feature. The retrospective fitment to a cable may also be achieved by means of providing a sheath or channel longitudinal to the flexible strip, through which a cable may be routed.

The opposing pairs of tabs may be provided singly as individual clips or connectors, that may be retrospectively fitted to a cable along its length in whatever number or spacing is deemed necessary to adequately anchor the cable to the MOLLE webbing. Once again, the retrospective fitment to a cable may be achieved by means of clips, ties, flexible hook-and-loop fasteners or some other suitable cable anchoring feature. The retrospective fitment to a cable may also be achieved by means of providing a sheath or channel through which a cable may be routed.

The sheath or clips described herein may be provided with a geometry that allows or that is optimised for the passage and/or anchoring of a flat ribbon-like cable or conductive textile cable, which cable advantageously measures no more than 25 mm or 1" in width in order to be fitted comfortably between two adjacent rows of MOLLE webbing.

In some embodiments, the opposing pairs of tabs may be provided as an integral part of a ribbon cable or electrically conductive textile cable, which itself advantageously measures no more than 25 mm or 1" in width in order to be fitted comfortably between two adjacent rows of MOLLE webbing.

According to another aspect of the present invention, there is provided a method of attaching a component to a substrate provided with MOLLE webbing by means of a connector according to any preceding claim, including the steps of fitting the connector to the MOLLE webbing by disposing the tabs below one or more loops of the MOLLE webbing, disposing a component between the connector and the substrate, whereby the component is held by and covered by the connector.

The method advantageously includes the step of bending, curving or folding the body portion of the connector and attaching the connector to at least one row and at least one column of the MOLLE webbing.

The component may be disposed in a channel of the connector. It may be fixed to or separable from the connector.

According to another aspect of the present invention, there is provided a connector for attachment to MOLLE webbing including a substantially flat body portion, first and second tabs extending laterally from the body portion in opposing directions, and a tie or coupling attached to the body portion, the connector being substantially rigid, the tabs having a length of between 2.5 and 3.8 centimetres.

The substantially flat body portion may have a length of at least 2.5 or 3.8 centimetres.

According to another aspect of the present invention, there is provided a push element for a coupling assembly, the push element including first and second side arms and a push shoulder or ring attached to the side arms, the side arms including struts extending laterally outwardly relative to the push shoulder or ring an being compressible laterally, wherein lateral compression of the side arms causes the push shoulder or ring to be moved in a longitudinal direction.

According to another aspect of the present invention, there is provided a coupling assembly including first and second coupling elements connectable together, a push element as specified herein connected to the first coupling element, wherein radial compression of the side arms causes the push shoulder or ring to push the second coupling element away from the first coupling element in an uncoupling direction.

Other aspects and advantages of the teachings herein will become apparent to the skilled person from the specific description below.

BRIEF DESCRIPTION OF THE DRAWINGS

Embodiments of the present invention are described below, by way of example only, with reference to the accompanying drawings, in which.

DETAILED DESCRIPTION OF THE PREFERRED EMBODIMENTS

The preferred embodiments described herein relate to systems for and methods of attaching wires, cables, tubing and so on to military load-carriage garments and equipment that utilise a MOLLE, PALS or similar attachment system.

In the described embodiments this is achieved by providing the cables (or the like) with a series of laterally disposed, opposing pairs of flexible tabs, that are so designed as to be tucked under MOLLE loops and thus serve to anchor the cables along their lengths to the surface of the load-carriage garment in a desired routing. The cables provided with such tabs may be employed to interconnect electrical devices carried on the body for the transmission of power and/or signals.

The tabs may be provided: integrally with the cable, potentially as a feature of a cable's outer layer; on a strip or sheath which in turn can be fitted retrospectively to a cable; on a strip that forms a channel against the outer surface of a load-carriage garment, through which channel a cable may be routed; as a multiplicity of individual pairs of tabs that may be fitted retrospectively to a cable; integrally with the cable, where the cable is a flat ribbon-like cable or a conductive textile cable, and the tabs are potentially a feature of that cable's outer layer or layers.

The description that follows first focuses on embodiments of mechanisms by which a flexible strip with pairs of opposing tabs may be attached to MOLLE webbing. The description then discloses various systems and methods by which the flexible strip may be attached to or may retain a cable.

The term cable as used herein may refer interchangeably to: a multiway cable, such as might constitute part of a PAN or audio system; a single wire, such as might constitute an antenna feeder, fibre optic cable or vest quick release cable; or tubing, such as hydration tubing. It is to be appreciated that the teachings herein are not limited to cables and similar components and could be used in connection with a large variety of components to be attached to a garment, bag or other carrier, especially flexible elongate components.

Figure 1:
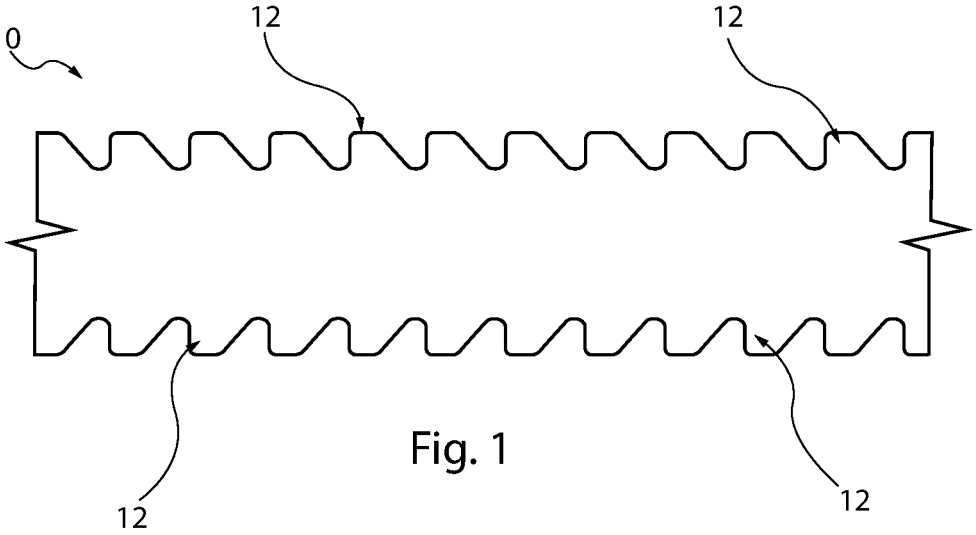
FIG. 1 is a photograph of a flexible strip showing an arrangement of laterally disposed tabs, in accordance with the teachings herein.

Referring first to FIG. 1, a flexible strip 10 is shown which comprises opposing pairs of flexible tabs 12 arrayed along its lateral edges. These tabs 12 may advantageously be formed from the material of the strip, and may, for example, be formed by a process of cutting such as by cutting press, laser cutting, CNC reciprocating knife cutter, and so on. The tabs 12 may also be formed integrally with the flexible strip 10 by a process of injection moulding or vacuum casting, for example. The flexible strip 10 may also be formed by an extrusion process, using rollers to cut or form the flexible tabs 12 along the lateral edges of the strip 10 as it is extruded. It is not excluded, however, that the tabs 12 may be formed as separate components from the strip 10 and attached thereto in any suitable manner, including bonding, gluing, suturing and so on.

The flexible strip 10 of FIG. 1 is also shown with a printed surface finish that serves to match the visible and infrared signature of a military load-carriage garment.

The tabs 12 may be relatively rigid (relative to the body of the strip) but are preferably as flexible as the body of the strip itself. In practice, the tabs may be made flexible enough that they can be fitted to MOLLE webbing by hand.

In the preferred embodiments, and applicable to all the embodiments disclosed herein and covered by the claims, the tabs may be formed from the outer sheath of the body of the strip, which may be 0.7 mm thick (typically of a thickness of 0.5 to one or a few millimetres). A preferred composition of the structure of the strip is two layers of a tri-laminate sandwich of 70 denier PU-coated ripstop nylon, 35 denier silver plated ripstop nylon and a face fabric of printed 70 denier ripstop nylon. The latter may in some cases be replaced by a heavier fabric, such as a 330, 500 or 1,000 denier nylon Cordura.

Figure 2:
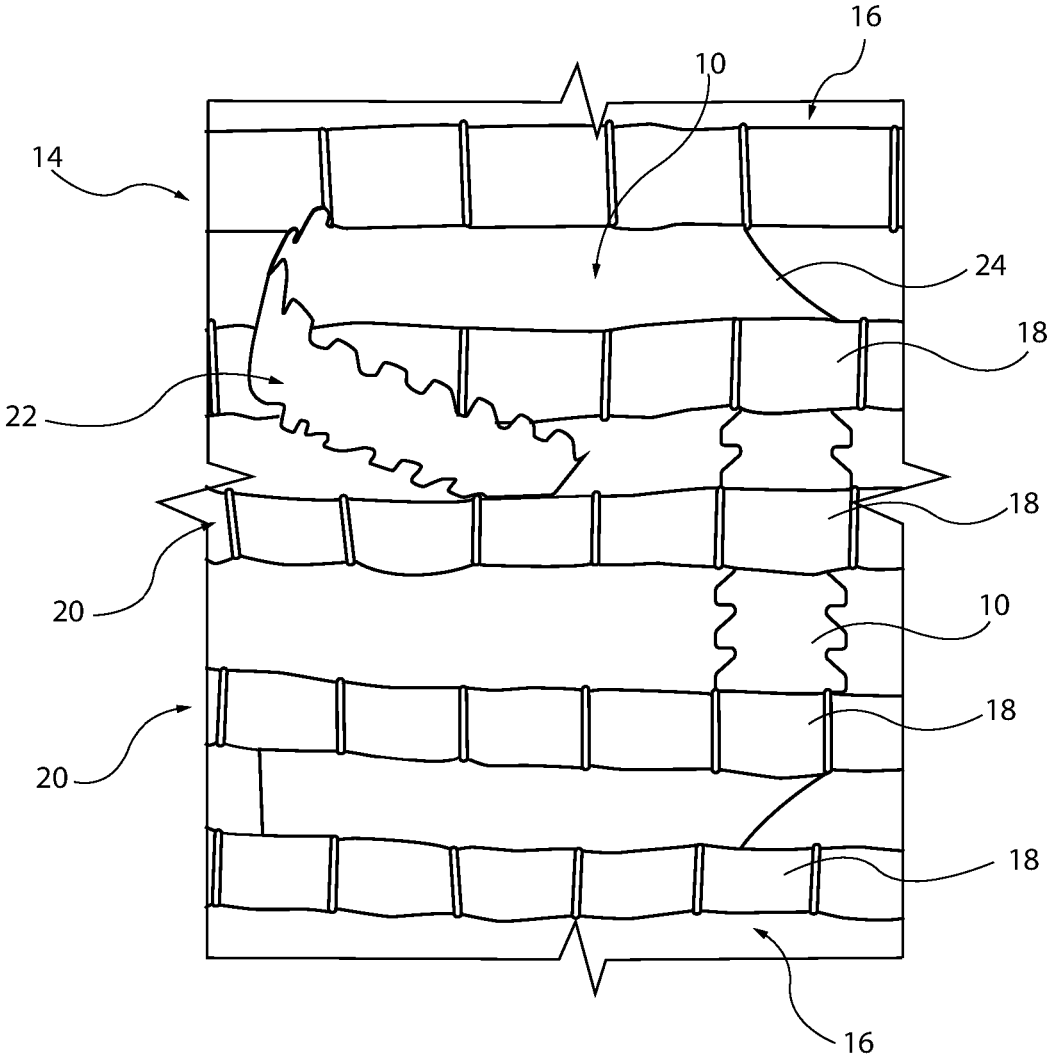
FIG. 2 is a photograph of the flexible strip of FIG. 1 shown attached to an array of MOLLE webbing on a military vest, in both horizontal and vertical directions.

Referring to FIG. 2, a similar flexible strip 10 is shown attached to a section 14 of MOLLE webbing. As can be seen, in a vertical orientation, the flexible strip 10 has dimensions that allow it to pass underneath a column 16 of MOLLE loops 18. The flexible strip 10 also has dimensions that allow it to be located in a horizontal fashion between two rows 20 of MOLLE loops 18, whilst the opposing pairs of tabs 12 are so sized and positioned that they may be tucked under the MOLLE loops 18 above and below the flexible strip 10 in order to effect attachment.

In the example configuration shown in FIG. 2, the flexible strip 10 is shown unattached at its upper end 22. Furthermore, in the example configuration of FIG. 2, the flexible strip 10 is folded (at 24) in order to transition from a vertical to a horizontal orientation and vice-versa. It is also envisaged that two or more shorter strips may be employed for achieving this transition between vertical and horizontal orientations, or that the strip may be formed from the outset with such right-angled turns already included in its geometry.

Figure 3:
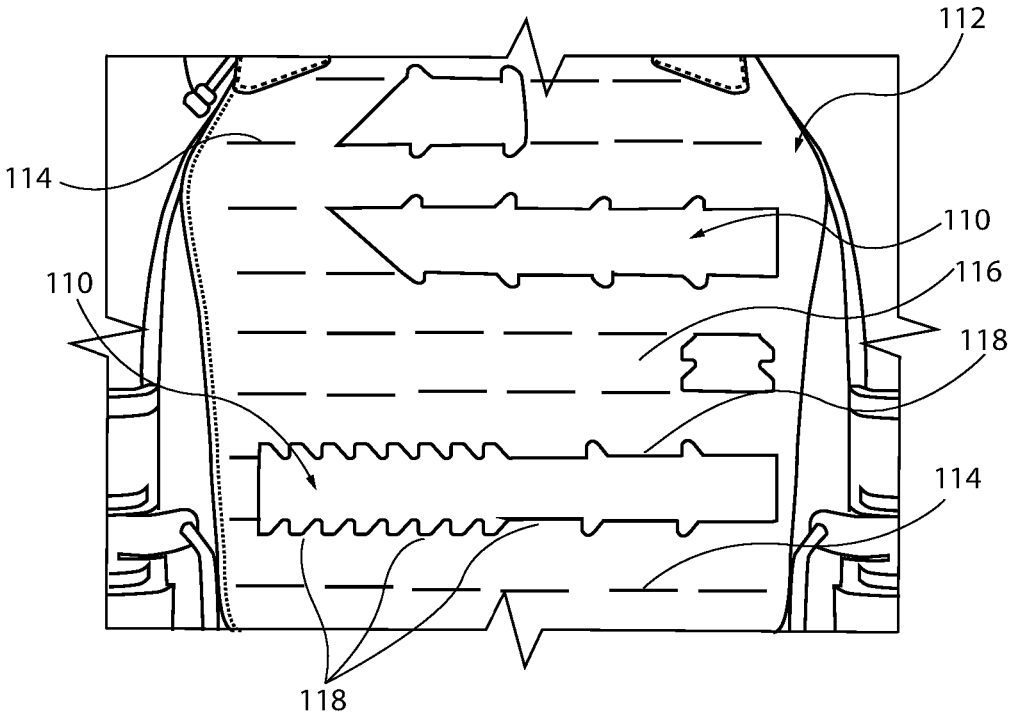
FIG. 3 is a photograph of the flexible strip of FIG. 1 shown attached to an array of laser-cut slots with MOLLE geometry on a military vest, in both horizontal and vertical directions.

Referring now to FIG. 3, this shows a flexible strip 110 attached to a load-carriage garment 112 that employs a series of laser-cut or die-cut slots 114 in its outer layer to replicate the effect of MOLLE webbing, referred to herein as laser-cut MOLLE. The flexible strip 110 is attached in a similar manner to that described above for FIG. 2.

The laser-cut MOLLE affords a slightly shorter attachment loop 116 than the 38 mm or 1.5" loop size provided by sewn MOLLE webbing. In the particular embodiment of flexible strip shown in this FIG. 3, this necessitates that one in every three of the flexible tabs 118 is not tucked under a loop 116, but the function and manner of attachment of the flexible strip 110 is not impaired.

Figure 4:
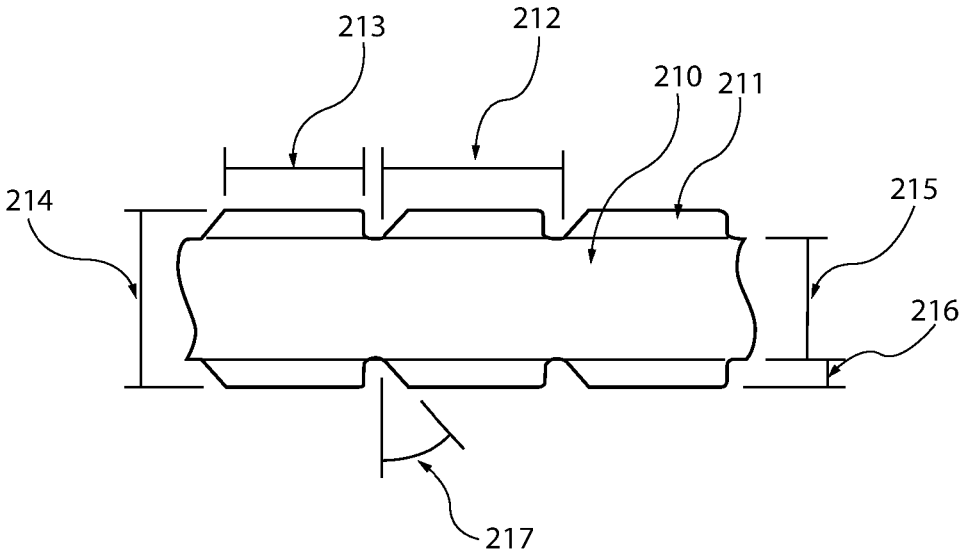
FIG. 4 is a schematic diagram of a portion of the flexible strip of FIG. 1 showing preferred dimensions of component elements thereof.

FIG. 4 shows a schematic diagram of a preferred embodiment of flexible strip 210. The strip 210 is shown with two lateral arrays of opposing tabs 211, which are preferably aligned in the longitudinal direction of the strip 210. This is not an essential requirement, or that the tabs need be of the same length, either on the same side or on opposing sides of the strip, although it is preferred that laterally opposing tabs are of the same size. This applies to all the other embodiments.

In all of the preferred embodiments, and with reference to FIG. 4, the tabs 211 have a lateral length, dimension 213, of not more than 38 mm or 1.5", such that they will fit under this standard length of MOLLE loop in a horizontal fashion.

In all of the preferred embodiments, and with reference to FIG. 4, it is advantageous for the tabs 211 to have a lateral length 213 of not more than 25 mm or 1", such that they will fit into the slots or holes of laser-cut MOLLE, which tend to have a length of less than 38 mm or 1.5", but equal to or more than 25 mm or 1". In this event, the lateral pitch of the tabs, dimension 212, preferably remains 38 mm or 1.5".

In all of the preferred embodiments, it is advantageous that the width of the central continuous portion of the strip, dimension 215, is less than or equal to 25 mm or 1.5", such that the strip fits comfortably between two adjacent rows of MOLLE webbing without deflection and strain. It may however be desired that in some circumstances the width of the central portion of the strip 215 exceeds 25 mm or 1.5", in which event the strip is deliberately strained whilst attached and thus effects a more positive retention force upon the MOLLE loops.

In all of the preferred embodiments, it is further advantageous for the overall width of the opposing pair of flexible tabs, dimension 214, to be not more than 38 mm or 1.5", such that the strip with its tabs may still be routed vertically by passing through a column of MOLLE loops.

In all of the preferred embodiments, it is advantageous for the tabs to have chamfered or radiused corners or angled sides, to assist in feeding the strip vertically through a column of MOLLE loops.

It may also be advantageous that the tabs have chamfering, radiusing or angled sides that are asymmetric, such that the strip can be fed vertically through MOLLE loops more easily in one direction. In the opposing direction, the tabs are more likely to be arrested by the MOLLE loops and thus mitigate unintentional movement of the strip or cable in that direction.

Multiple factors and dimensions may be controlled during manufacture in order to achieve a desired degree of fastness of attachment between the strip and the MOLLE webbing. These include, for instance: the width of the tabs 211, that is dimension 216; the length of the tabs 211, that is dimension 213; the angle and degree of chamfering of the tabs 211, that is dimension 217; the stiffness of the tab material; the thickness of the tab material.

In another, slightly modified embodiment of the invention, the strip may be constructed of a more rigid and therefore stronger material by providing: a central portion of the strip 210 of less than 25 mm or 1" width in dimension 215; a combined width of the central portion and the lower tabs of 25 mm or 1", that is dimension 215+216; and a width of upper tabs (that is, on one side of the strip) equal to approximately twice the width of the lower tabs (that is, on the other side of the strip). This more rigid strip may be attached by first fully inserting the upper tabs under a top row of MOLLE loops, then dropping the assembly to insert the shorter lower tabs under a bottom row of MOLLE loops. In practice, however, such a more rigid strip fails to conform around the contours of a garment which renders it difficult to use, although can be advantageous in other equipment where flexibility of the equipment per se in not needed or important. Suitable materials include steel, aluminium, or rigid polymer such as glass-filled nylon. This embodiment has the advantage that the tabs need not be flexible but substantially rigid. Thus, it may be employed where a device or accessory demands a composition such as steel or aluminium or the like.

Figure 5:
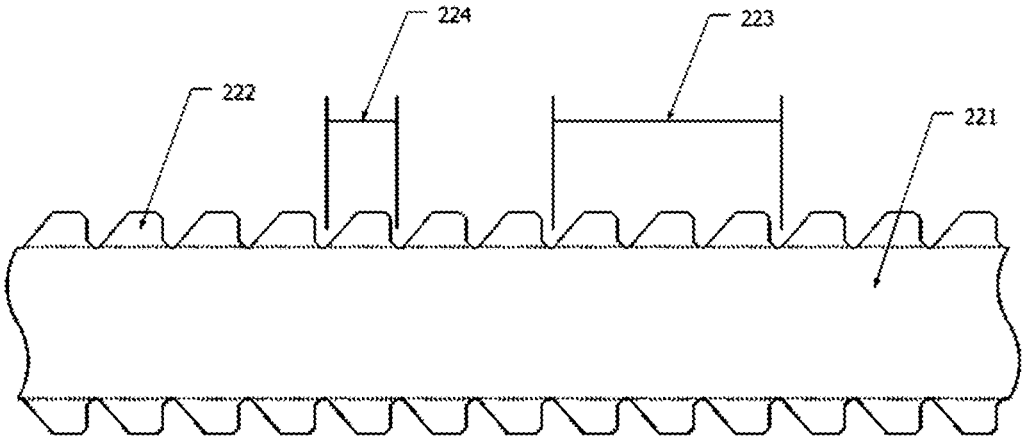
FIG. 5 is a schematic diagram of another embodiment of flexible strip, showing preferred dimensions of component elements thereof.

Referring now to FIG. 5, in all of the preferred embodiments of the flexible strip 221, it is further advantageous for the tabs 222 to have a longitudinal length, dimension 224, less than 38 mm or 1.5", and less even than the advantageous 25 mm or 1" dimension explained above.

Generally, a greater number of shorter tabs confers the advantages of: greater versatility with regard to longitudinally positioning the strip relative to the rows of MOLLE loops; greater redundancy, should any tabs become broken and unable to function at retention; improved compatibility of the tabs with laser-cut MOLLE, where certain of the tabs are not employed as outlined in the description of FIG. 3. In all cases where tabs shorter than 38 mm or 1.5" are employed, the pitch of the repeated geometry, dimension 223, preferably remains 38 mm or 1.5" to retain compatibility with the horizontal pitch of the MOLLE loops.

It is particularly advantageous in some embodiments for the tabs to have a longitudinal length 224 of approximately 12.5 mm or 0.5". In this way, three such tabs have a length of 38 mm or 1.5", retaining compatibility with the horizontal pitch of MOLLE loops. Two such tabs have a length of 25 mm or 1", so are compatible with the 25 mm or 1" dimension of either the vertical spacing between rows of MOLLE loops, or the minimum length of laser-cut MOLLE slots or holes. In other words, the tab length is a common factor of both the horizontal and vertical MOLLE pitches.

It is to be appreciated that in some embodiments, the tabs of a strip may have differing lengths in the longitudinal direction of the strip, and they may equally or alternatively have different widths in the lateral direction.

There are various methods by which the flexible strip may be attached to or retain a cable.

Figure 6:
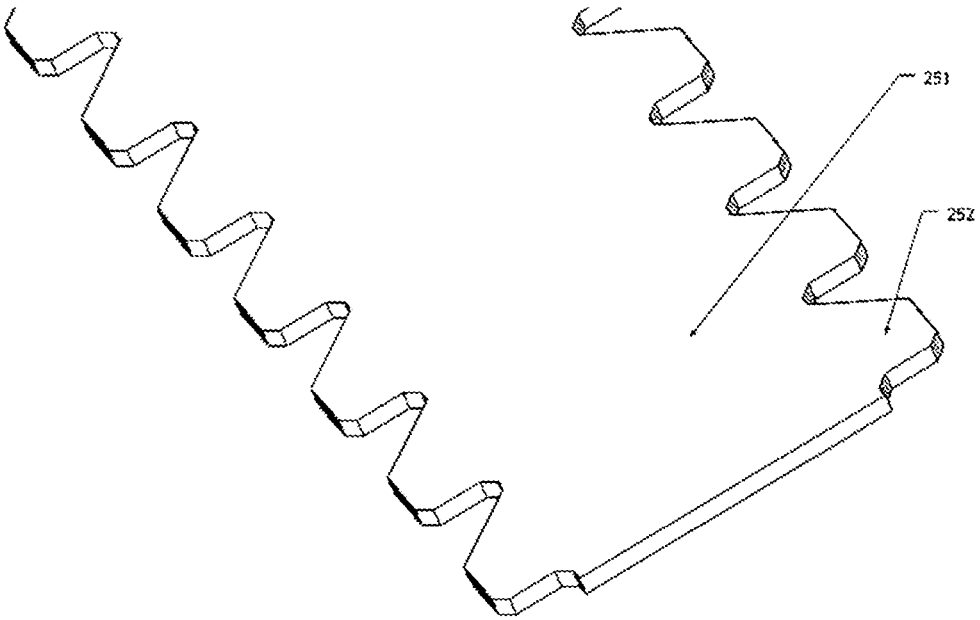
FIG. 6 is a diagram showing a perspective view of a flexible strip in accordance with the embodiment of FIG. 5.

Referring to FIG. 6, this is a perspective drawing of a preferred embodiment of the invention and shows a portion of a flexible strip, 251, having opposing pairs of flexible tabs 252 arrayed along its lateral edges, in similar manner as described above.

Such a flexible strip may be anchored horizontally between two adjacent rows of MOLLE webbing by means of its tabs, or passed vertically underneath a column of MOLLE loops, in order to form a pocket or sheath or conduit against the outer layer of a load-carriage garment and through which pocket or sheath or conduit a cable may be passed. This can be seen in the examples of FIGS. 2 and 3. Specifically, when the strip is attached to a MOLLE webbing, it creates a channel or housing between itself and the substrate material to which the MOLLE webbing is sewn or cut. A cable or other elongate component can be disposed in that channel or housing and held in place, as well as protected, by the strip.

Advantageously, the strip is low in profile height, so as to be predominantly sheet-like. The material and profile height of the strip should provide sufficient flexibility to the strip for it to be deflected and fitted between two adjacent rows of MOLLE webbing. It may have a height of less than around 5 mm. It can be made of polypropylene, polythene, nylon, ABS, polyurethane, silicone rubber or similar elastomer. The strip may be provided with additional holes, cuts, vents or serpentine features in order to, for example: improve its flexibility; allow the ingress or egress of cables; aid in cutting the strip to a desired length; or reduce the weight of the strip. This may be in the form of a series of slots or holes in a longitudinal array, such that the strip becomes somewhat segmented. In this way, longitudinal flexibility is increased while lateral rigidity is retained. The strip has enhanced flexibility along its length, while remaining stiff enough laterally to retain attachment to MOLLE webbing.

The strip may also advantageously be provided on at least its outward face with a printed, dyed, painted or laminated finish that duplicates the visual and/or infrared signature of the load-carriage garment to which the strip is appended.

The tabs may advantageously be formed from the material of the strip. Suitable processes for forming such a geometry of strip are well known in the art, and may include, for example, a process of cutting such as by die-cutting press, cutting roller, laser cutting, CNC reciprocating knife cutter, and so on. The tabs may also be formed integrally with the flexible strip by a process of injection moulding or vacuum casting, for example. The flexible strip may also be formed by an extrusion process, using rollers to cut or form the flexible tabs along the edges of the strip as it is extruded.

Compared to other embodiments of the invention described herein, the preferred embodiment of FIG. 6 offers the advantages of: being relatively simple to manufacture; being inexpensive; being straightforward for a user to understand and fit; having wide compatibility with existing cables of various diameters, or with multiple cables.

Compared to other cable anchoring solutions in the prior art, the preferred embodiment of FIG. 6 offers the advantages of: not occupying any MOLLE loops that might otherwise be used for pouches or equipment; presenting a flat front surface that minimises snag hazards and allows pouches and equipment to be mounted over it; encapsulating the cable along its entire length, thus minimising snag hazards, tangling and avoiding cable kinks that might cause premature fatigue failure; offering a relatively wide and versatile channel that may retain multiple cables or cables of varying diameter; covering the cable to protect it from abrasion, conceal it and reduce its signature.

Figure 7:
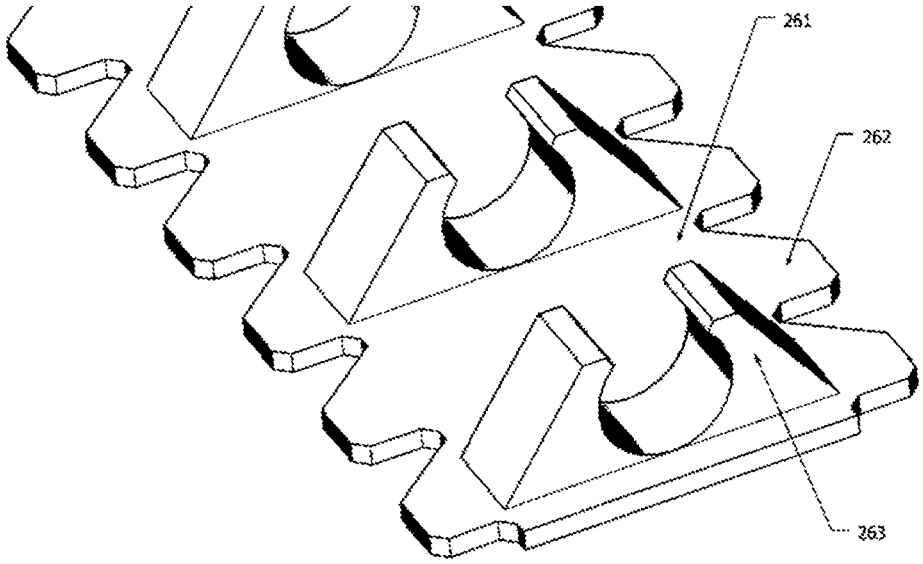
FIG. 7 is a diagram showing a perspective view of an embodiment of flexible strip disposed along its length with an array of cable clips.

Referring now to FIG. 7, this perspective drawing of another embodiment shows a portion of a flexible strip 261 which is provided with opposing pairs of flexible tabs 262 arrayed along its lateral edges. Whilst similar in all other respects to the flexible strip described above, this embodiment also provides a series of cable clips 263 that can be used to attach a cable along its length. The clips 263 may be moulded integrally to the strip as part of its fabrication. In the case where the strip is fabricated by being cut from a sheet, cable retention might be provided by slots through which the cable may be threaded or woven, or tabs cut within the body of the strip that may be deflected outwards in order to capture the cable. Other means of attaching a cable to the flexible strip might include ties, elastic loops, flexible hook-and-loop fasteners or some other suitable cable anchoring feature.

This embodiment of FIG. 7 offers the advantage that it is faster and simpler to attach or remove a cable.

Figure 8:
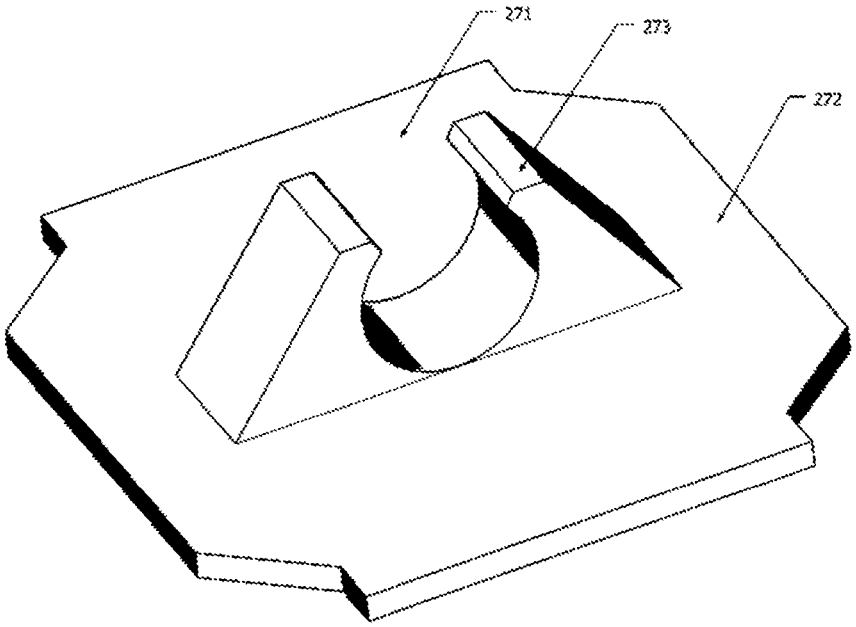
FIG. 8 is a diagram showing a perspective view of a single cable clip disposed with an opposing pair of flexible tabs, of the embodiment of FIG. 7.

Referring to FIG. 8, this drawing shows an embodiment of the invention that comprises an elemental length of the strip described above 271, providing a single pair of opposing tabs 272 and a single cable clip 273. This embodiment offers the advantage of versatility of application, in that a cable might be anchored only in certain key locations without adding the weight and bulk of a whole strip to a load-carriage garment.

When embodied as a single elemental clip as shown in FIG. 8, the invention still offers the advantage over similar clips from the prior art that it does not occupy, that is render otherwise non-functional, a MOLLE loop.

Indeed, it can be envisaged that the strip of FIG. 7 might be provided with perforations or score lines such that the strip may be cut to length or subdivided into many elemental clips such as the embodiment shown in FIG. 8.

Figure 9:
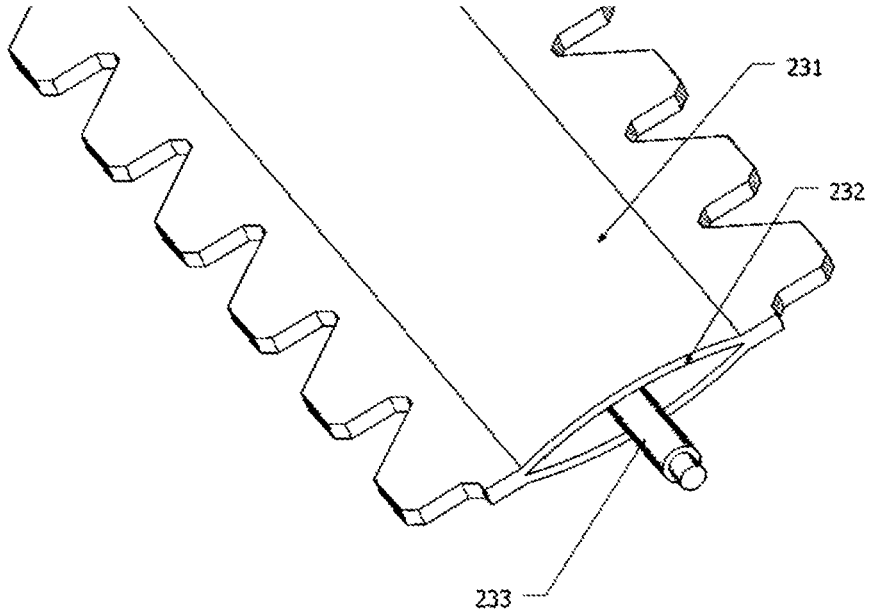
FIG. 9 is a diagram showing a perspective view of an embodiment of flexible sheath for a cable disposed along its length with opposing pairs of flexible tabs.

FIG. 9 now shows an embodiment of the invention wherein the strip of FIG. 6 is constructed with a longitudinal void 232 within its central continuous portion 231. This void forms a sheath or channel through which a cable 233 may be routed.

The sheath may be continuous in cross-section, in order completely to encircle a cable and offer greater protection, or else may be split longitudinally or transversally (or even at an angle) to offer easier insertion of a cable.

The sheath may additionally incorporate an adhesive internal to the void and/or have a heat-shrinking characteristic, such that a cable might be permanently attached to the strip 231.

In all other respects, the sheath is similar in nature and function to the strip illustrated in FIG. 6 and the preceding Figures, with the distinction that it constitutes a means to retrospectively apply the invention to a cable per se, rather than to a load-carriage vest.

Figure 10:
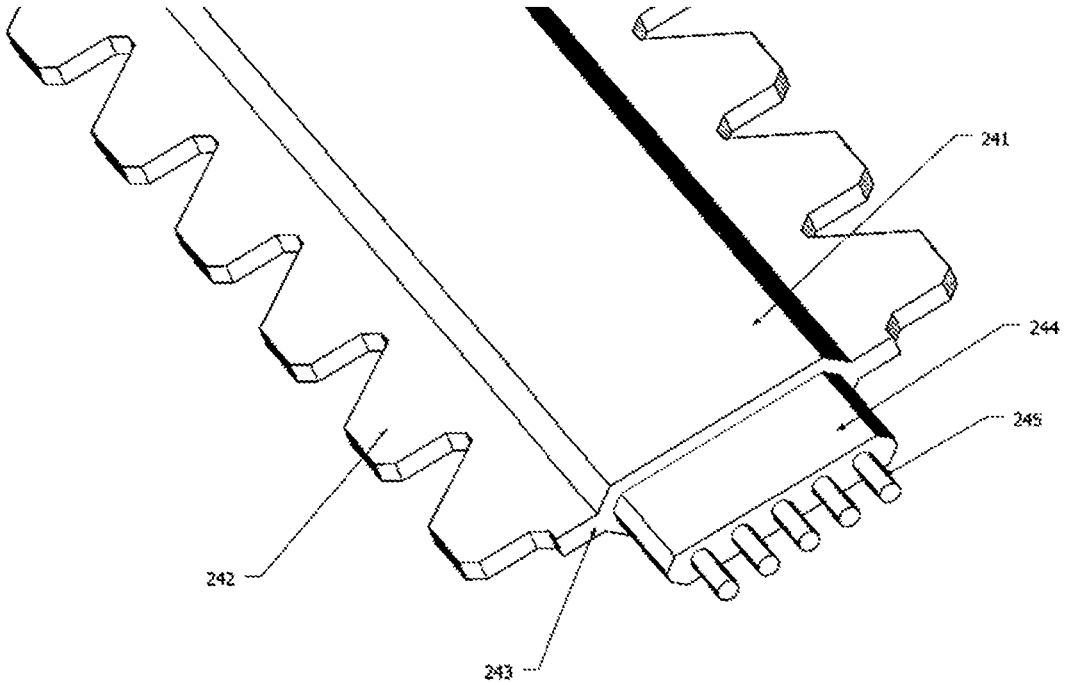
FIG. 10 is a diagram showing a perspective view of an embodiment of flat ribbon cable or conductive textile cable disposed along its length with opposing pairs of flexible tabs.

FIG. 10 now shows an embodiment of the invention in which a sheath 241 with opposing pairs of tabs 242 is used to longitudinally encapsulate a flat ribbon-like or conductive textile cable 244, in which the electrical conductors 245 are arranged in a parallel and coplanar fashion.

The sheath 241 and tabs 242 in FIG. 10 may be fabricated separately from the flat cable, and applied retrospectively as described above for the embodiment shown in FIG. 9. The sheath 241 may alternatively be formed integrally with the flat cable and constitute the outer layer or layers of the flat cable 243, formed by moulding, cutting, extruding and so on as described elsewhere herein.

The sheaths 231 or 241 may be formed from impermeable layers, shielding layers and outer covering layers as described in the Applicant's earlier application "Conductive Textile Assembly with Electrical Shielding Structure", PCT/GB2019/050430. The tabs 242 may be formed from the bonded edges of these layers through a process of laser-cutting or die-cutting or the like.

The embodiment shown in FIG. 10 therefore offers the advantage of reduced weight and bulk compared to the other embodiments described herein, as the material that comprises the sheath or strip can also perform some of the functions necessary to the cable itself, such as screening, environmental or abrasion protection.

In yet another embodiment of the invention, a conventional cable of circular cross-section, with bundled rather than coplanar conductors, may also be provided with lateral opposing tabs in a similar fashion to that described for the embodiment of FIG. 10. Such a cable is co-extruded with its outer insulation layer in the fashion known in the art, with the addition of a pair of opposing lateral wings (or wing sets) formed through the shape of the extrusion die. The tabs described herein are then formed by passing the lateral wings through a pair of rollers that form or cut the shape of the tabs as the cable is extruded.

Figure 11:
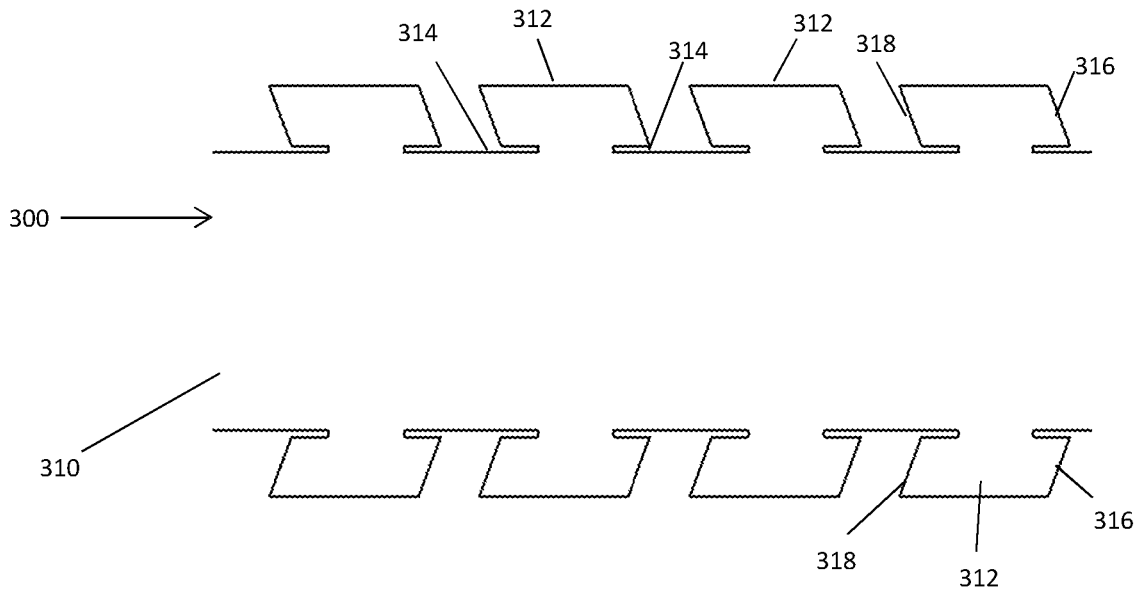
FIG. 11 is a plan view of another embodiment of flexible strip.
Figure 12:
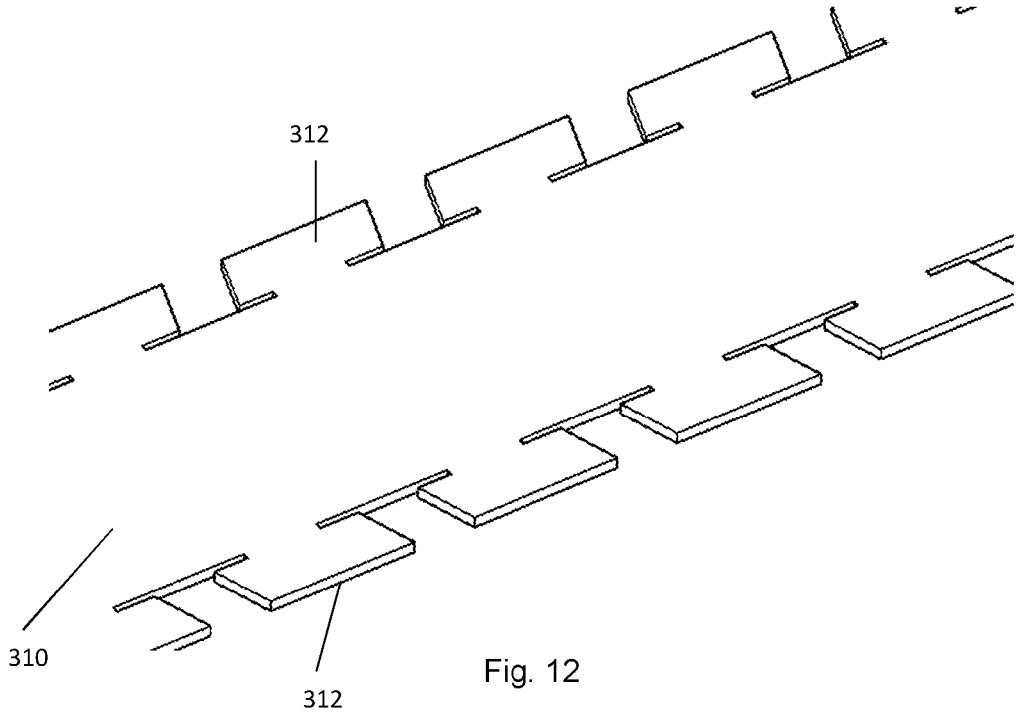
FIG. 12 is a perspective view of the embodiment of FIG. 11.

Referring now to FIGS. 11 and 12, these show another embodiment of flexible strip (300) for a connector according to the teachings herein. The strip (300) has the same characteristics as the other strips disclosed herein, with the primary difference being in the shape and configuration of the tabs 312 that extend laterally from the body portion 310 of the flexible strip 300. In this embodiment, the tabs 312 include slits 314 either side thereof to provide free longitudinal ends to each of the tabs 312. This embodiment also shows the tabs having a tapering leading edge 316 and a tapering trailing edge 318, which can assist in the fitting of the connector to MOLLE webbing from the leading end first. In other embodiments, the longitudinal ends of the tabs 312 may be orthogonal to the longitudinal direction of the body portion 310.

Figure 13:
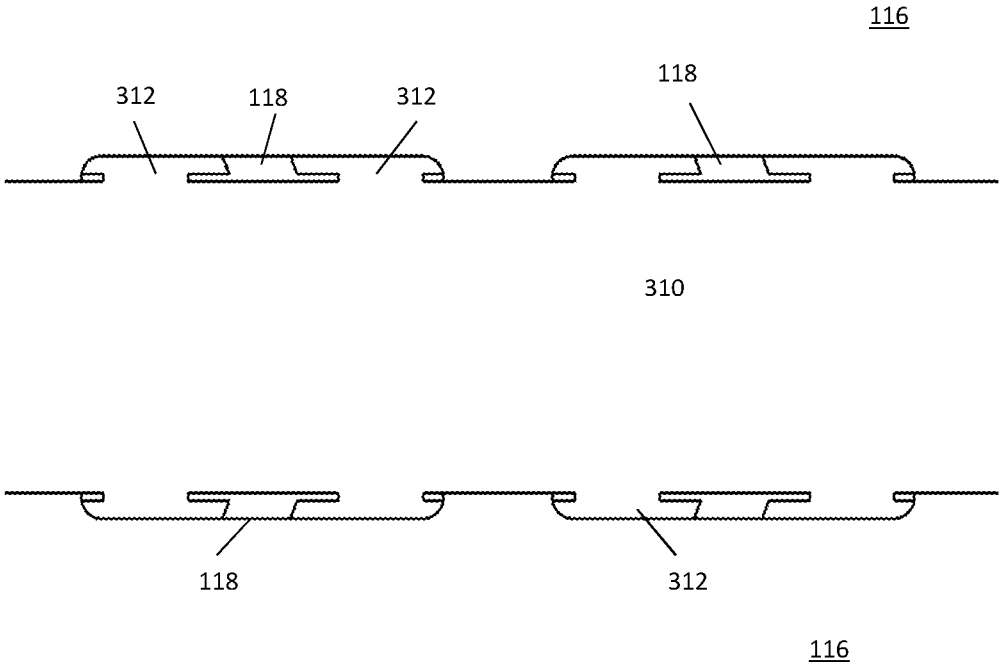
FIG. 13 is a schematic diagram showing the strip of FIGS. 11 and 12 fitted to MOLLE webbing.
Figure 14:
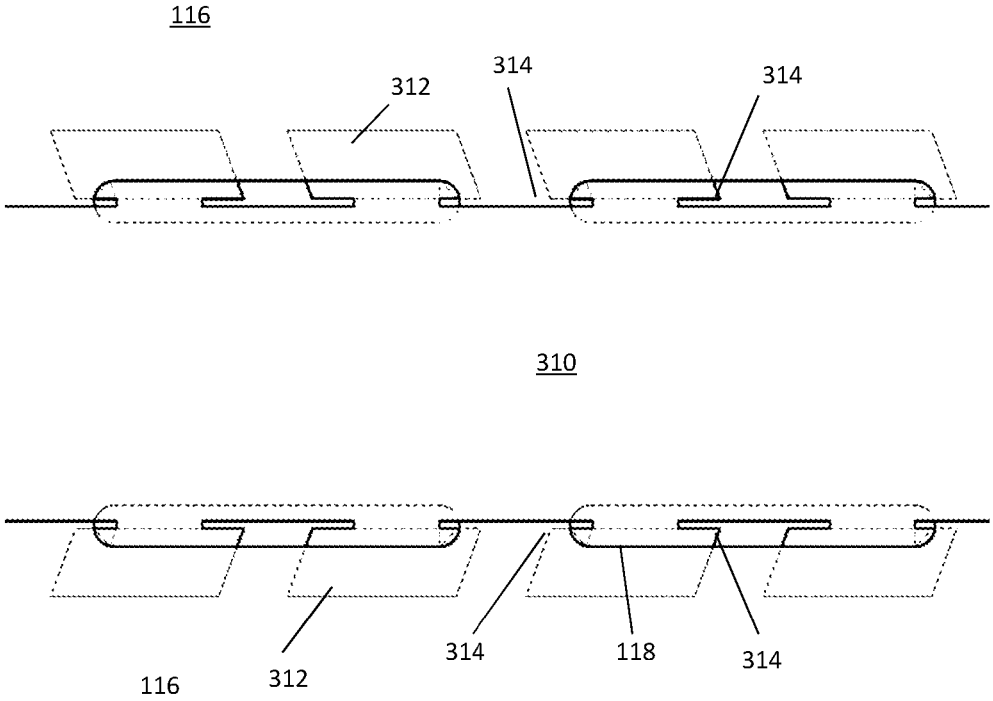
FIG. 14 is a schematic diagram similar to FIG. 13 showing the tabs disposed underneath the MOLLE webbing in dotted outline.

With reference now to FIGS. 13 and 14, these show the flexible strip 310 fitted to a laser cut array of MOLLE strips similar to that shown in FIG. 3. The tabs 312 fit within the slots 118 of the MOLLE webbing 116 and, as can be seen in particular with reference to FIG. 14, the slits 314 enable a part of the tabs to be caught at the ends of the slots in the MOLLE webbing, thereby acting as anchoring or fixation points. For this purpose, it is preferable that the spacing between the leading edge of one tab and the trailing edge of an adjacent tab is greater than the length of the aperture or slot in the MOLLE webbing, so as to ensure that the MOLLE webbing captures the slots of the tabs of the connector strip. It should be appreciated that in other embodiments, the two adjacent tabs 312 could be replaced by a longer tab.

Figure 15:
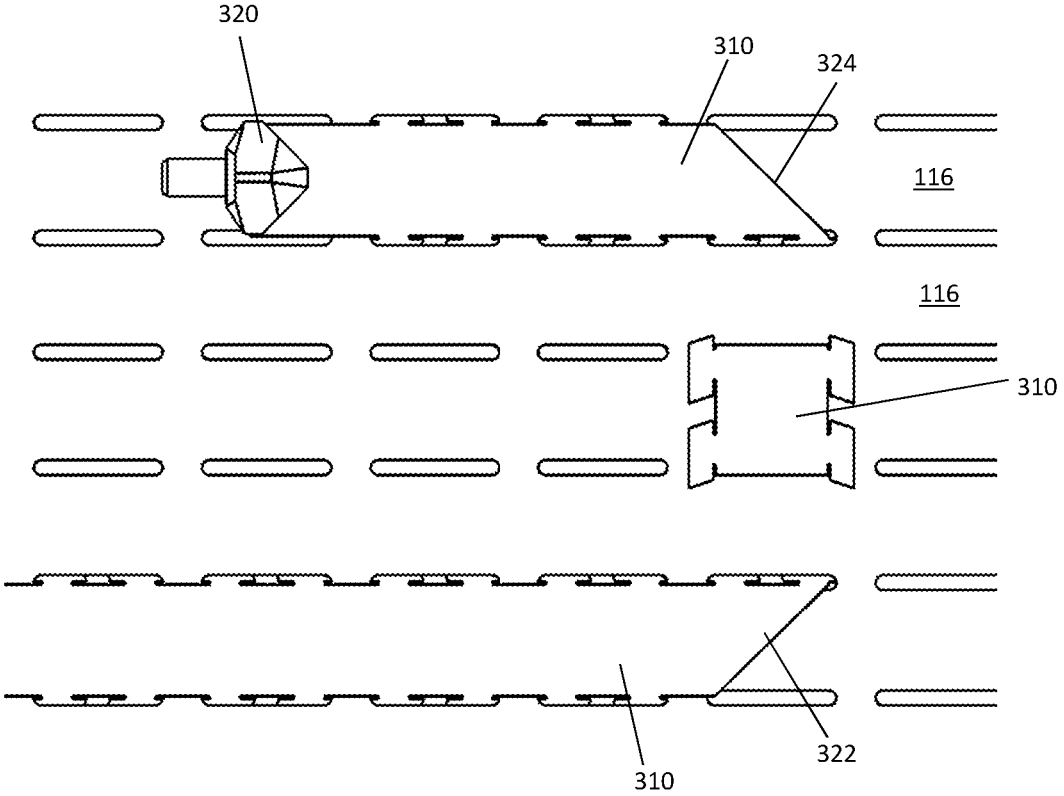
FIG. 15 is a perspective view showing an embodiment of connector comprising a flexible strip similar to the embodiment of FIGS. 11-14, fitted to MOLLE webbing.
Figure 16:
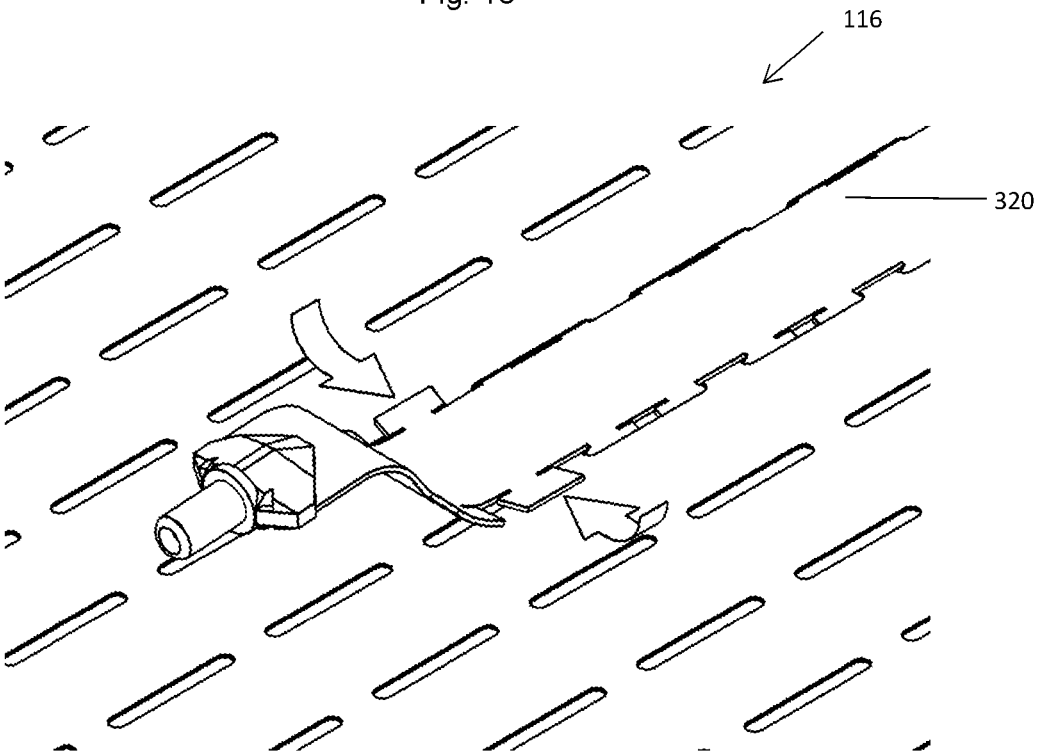
FIG. 16 shows schematically a method of attaching the connector of FIG. 15 between rows of MOLLE webbing.
Figure 17:
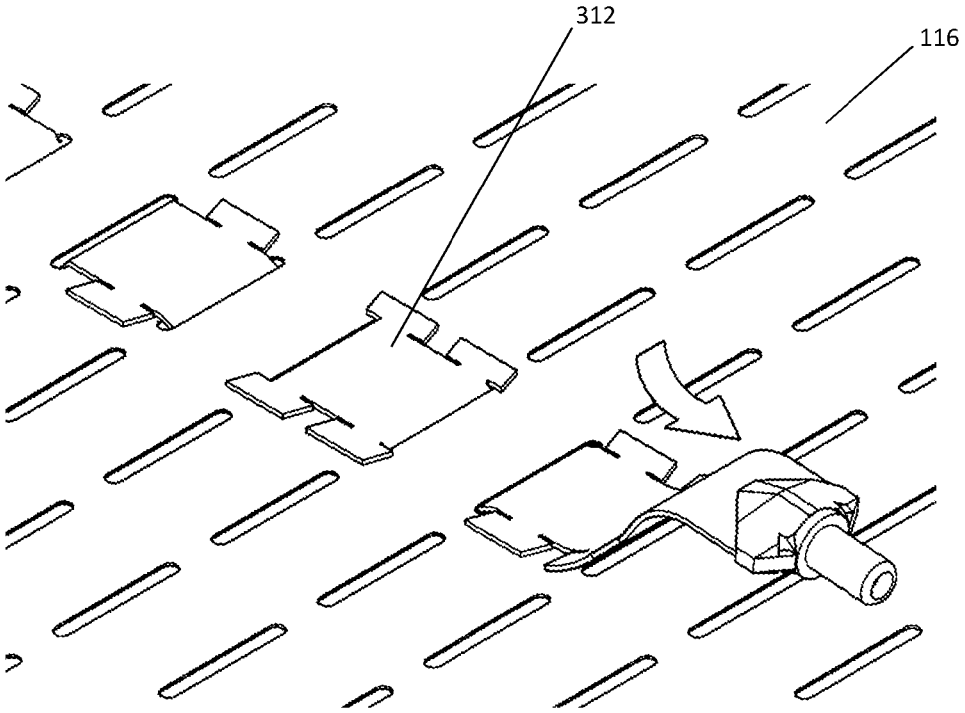
FIGS. 17 and 18 show a method of fitting the connector of FIG. 15 across strips of MOLLE webbing.
Figure 18:
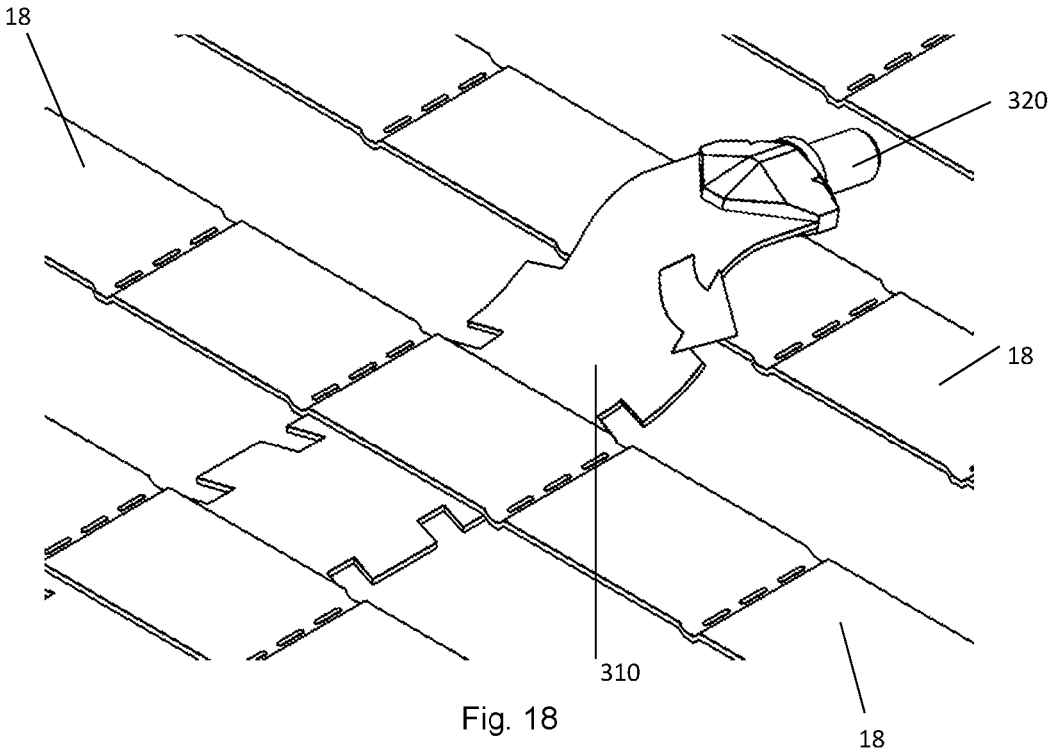
Figure 19:
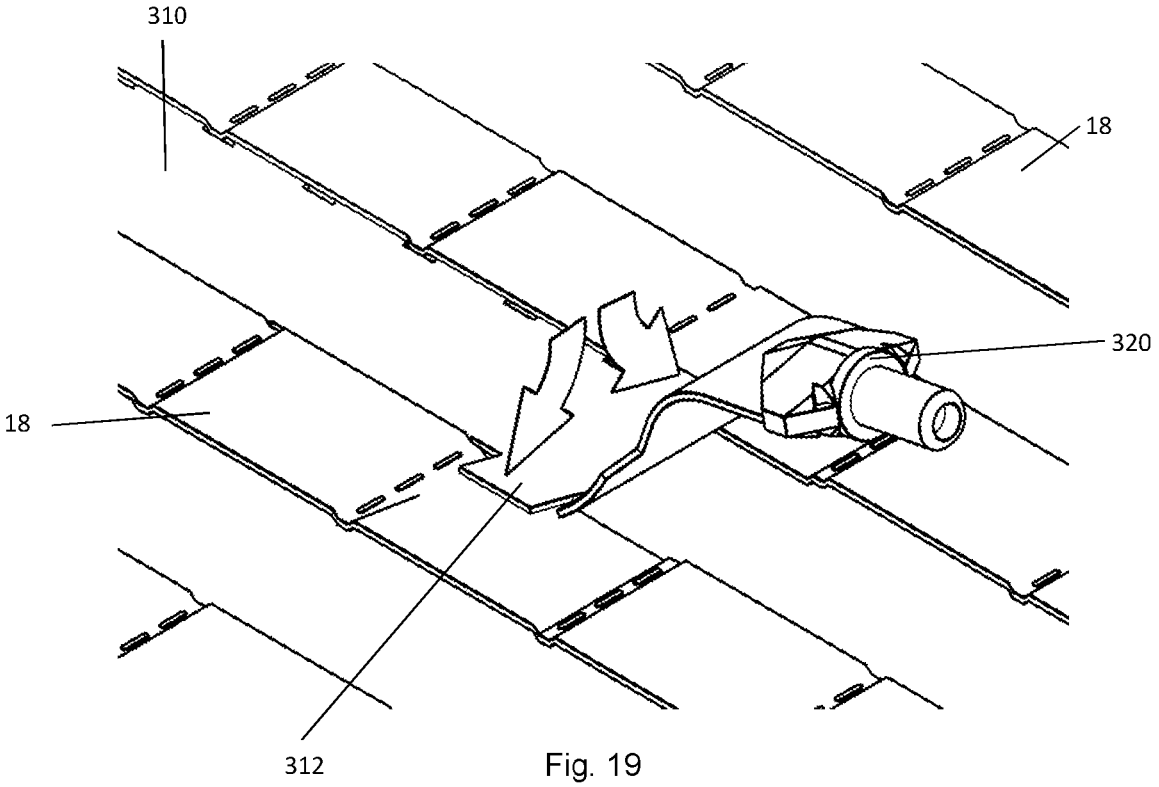
FIG. 19 depicts schematically a method of fitting a connector as per FIG. 15 between rows of MOLLE strips.

Referring now to FIG. 15, this shows an example of the flexible strip shown in FIGS. 11-14 to which a coupling element 320 is fitted at one end. In this example, the elongate strip 310 has a central channel of the nature shown in FIG. 9 for the passage of, for example, wires, electrical cables and the like through the connector 310. As will be apparent in FIG. 15, the flexible strip 310 extends along two rows of MOLLE webbing, is folded 90° at fold line 392 so as to pass in an orthogonal direction across rows of MOLLE webbing 116 and is folded again at 324 so as then to extend along two adjacent rows of MOLLE webbing in the opposite direction to the first portion, shown at the bottom of FIG. 15. It will be appreciated that, as with the preferred embodiments, the strip 310 is flexible enough to be folded on itself, with preferably the folded facing surfaces of the MOLLE webbing being in contact with one another. In other words, the connector is preferably flexible enough so as to remain substantially flat when folded. This is a preferred characteristic of all embodiments of flexible strip and connector disclosed and envisaged in this application.

With reference to FIGS. 16-19, these show the embodiment of connectors shown in FIG. 15 being fitted to the MOLLE webbing, the arrows depicting how the connector can be fitted and attached to MOLLE webbing. The tabs 312 are preferably flexible enough that they can be folded into slots in the MOLLE webbing or underneath the strips 18 of MOLLE webbing simply with hand force.

Figure 20:
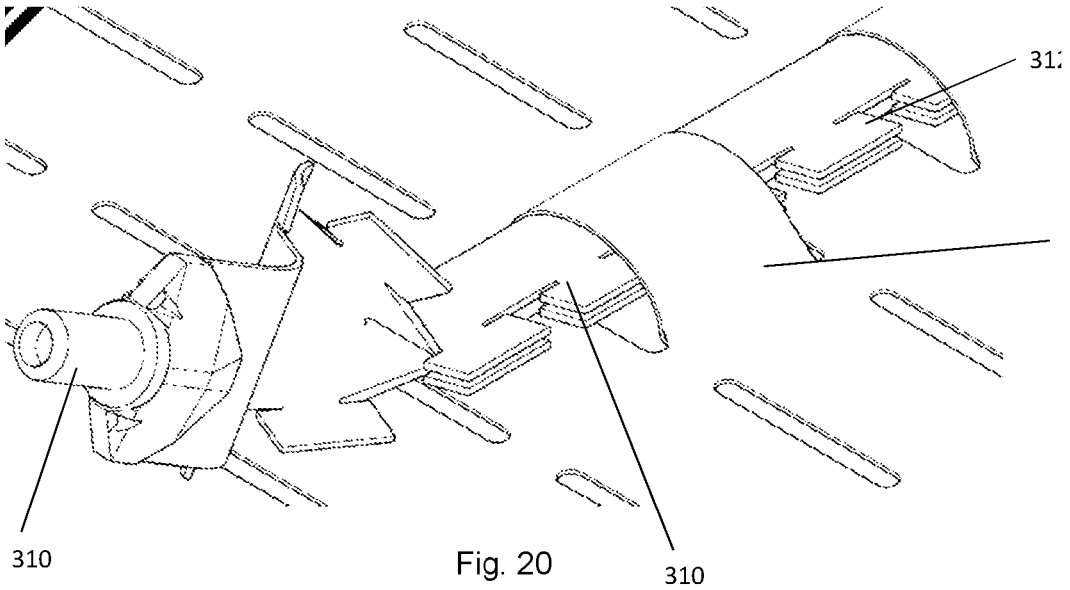
FIG. 20 depicts schematically another method of coupling the connector of FIG. 15 through adjacent rows of MOLLE strips.

FIG. 20 shows another example of fitting of the connector to MOLLE webbing 116. In this example, the strip 310 is folded longitudinally so that the tab 312 lay the same side, and are preferably together with the half width of strip 310 narrower than the aperture between MOLLE loops, enabling the strip 310 to be pulled through the loops prior to unfolding and connecting via the tabs 312.

Figure 21:
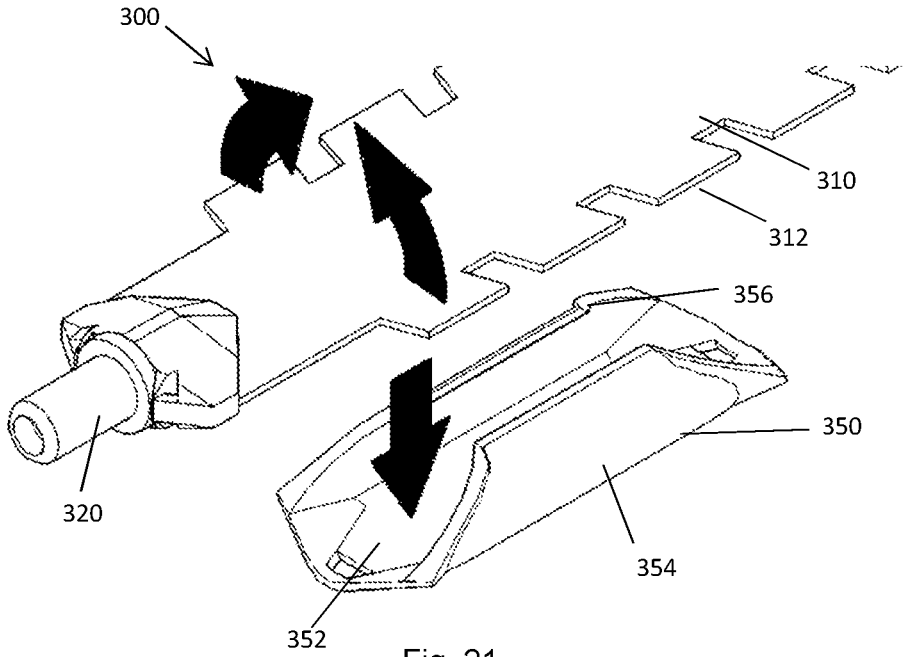
FIGS. 21-23 show an embodiment of insertion tool for use with a connector as taught herein.
Figure 22:
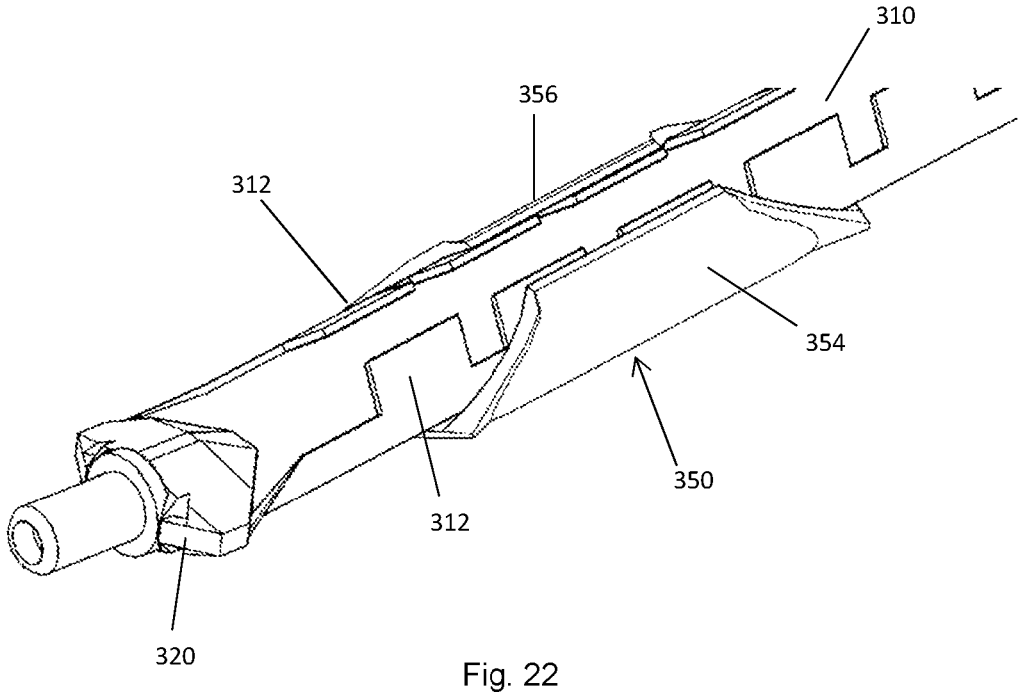
Figure 23:
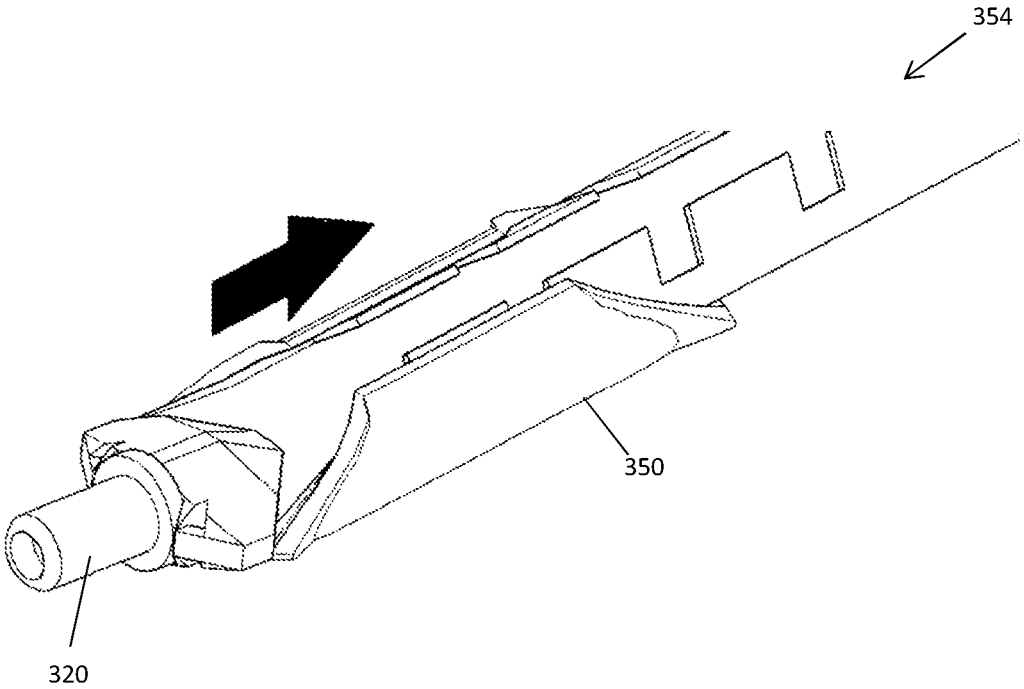

With reference to FIGS. 21-23, these show an insertion tool 350 that can be used in fitting the connector to MOLLE webbing. The tool 350 includes a base 352 and upstanding flanges 354 which taper towards one another from the base 352. A connector can be fitted into the tool 350, as depicted in FIGS. 22 and 23, and in such a manner that the tabs 312 are deflected by the flanges 354, 356. For this purpose, the width of the base 352 is preferably around the same as the width of the elongate strip 310 of the connector, although it may be narrower.

Figure 24:
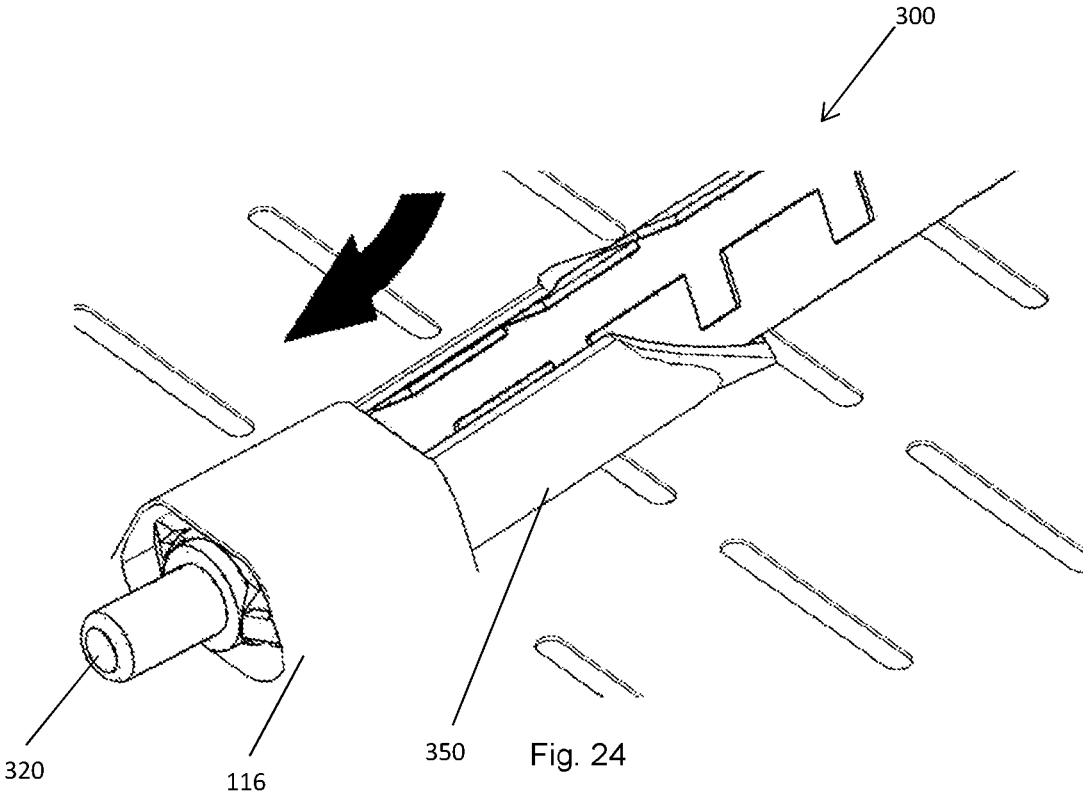
FIGS. 24-26 show how the insertion tool of FIGS. 21-23 can be used to fit a connector as taught herein to MOLLE webbing.
Figure 25:
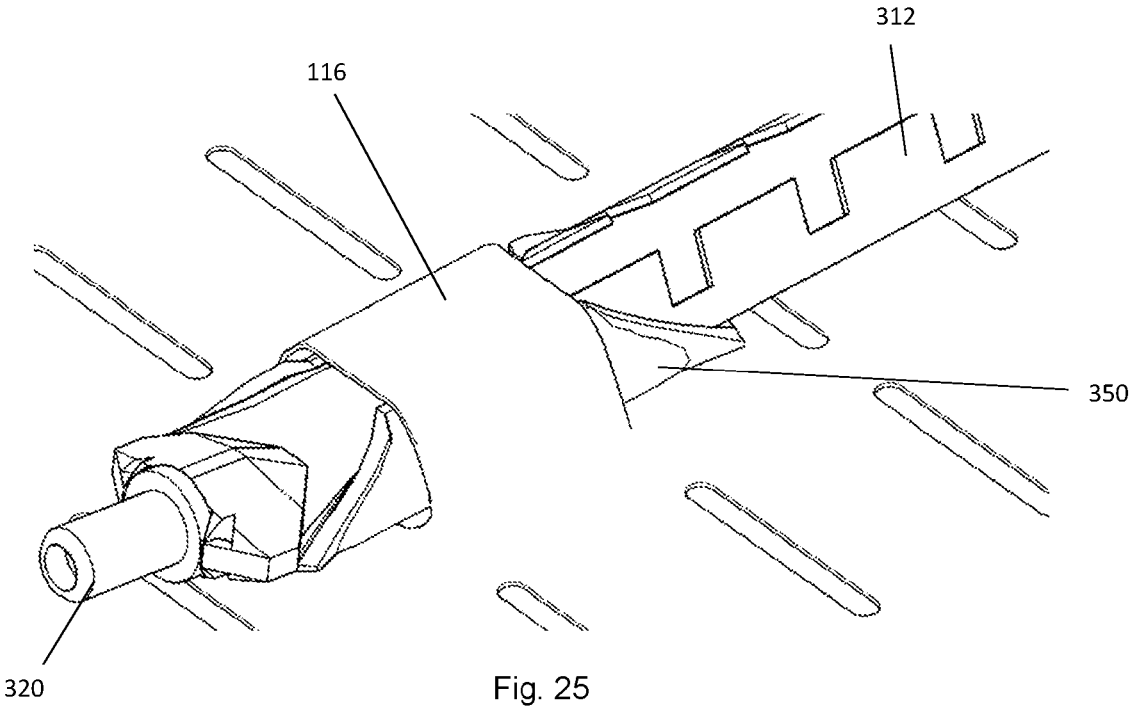
Figure 26:
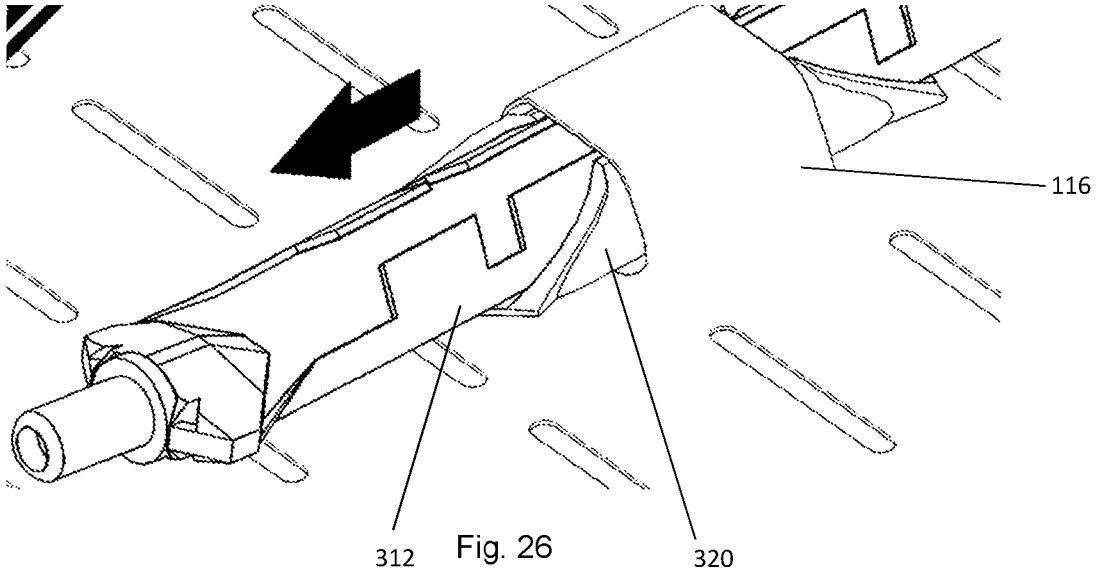
Figure 27:
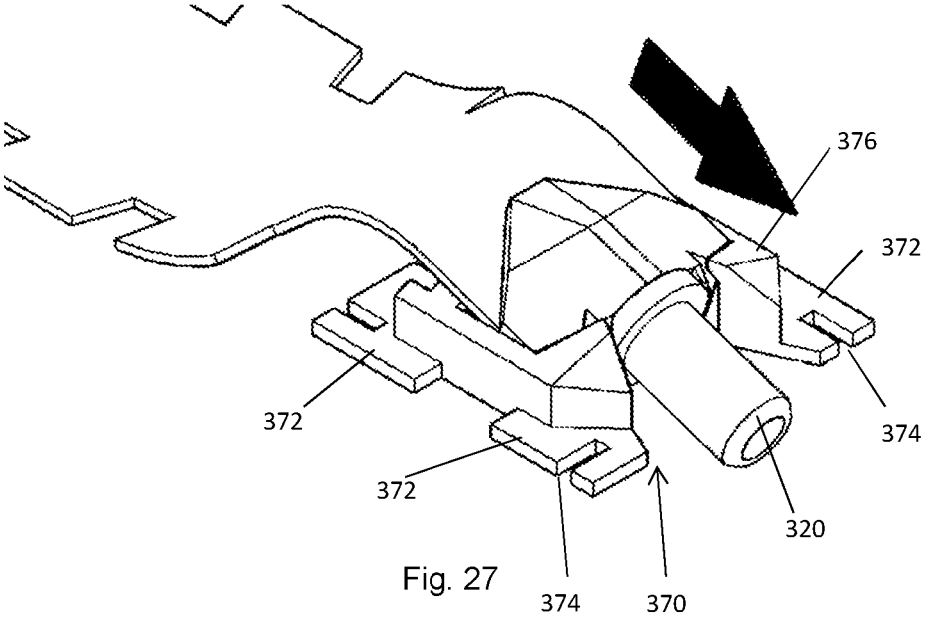
FIGS. 27-33 show a fixation frame for attaching a coupling element at an end of a flexible strip to MOLLE webbing.
Figure 28:
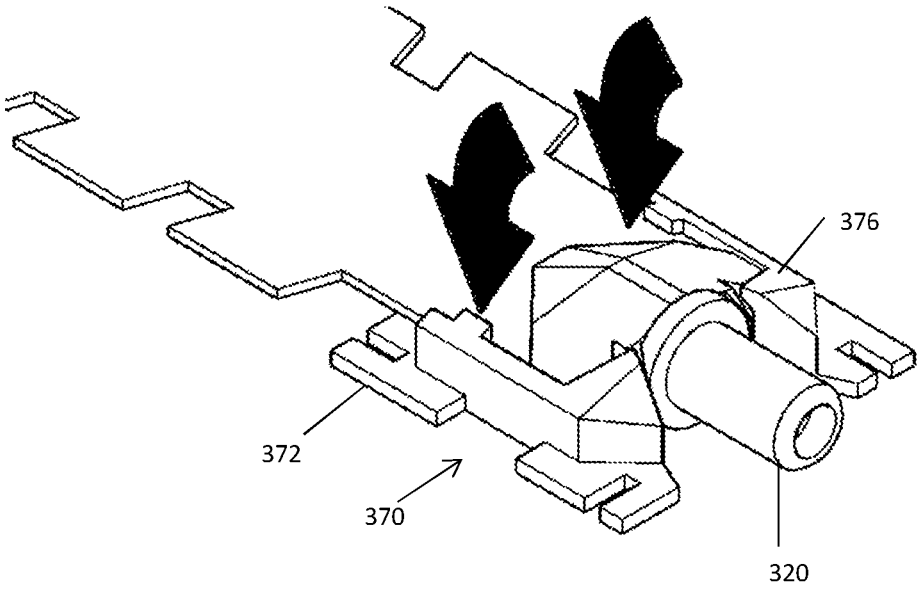
Figure 29:
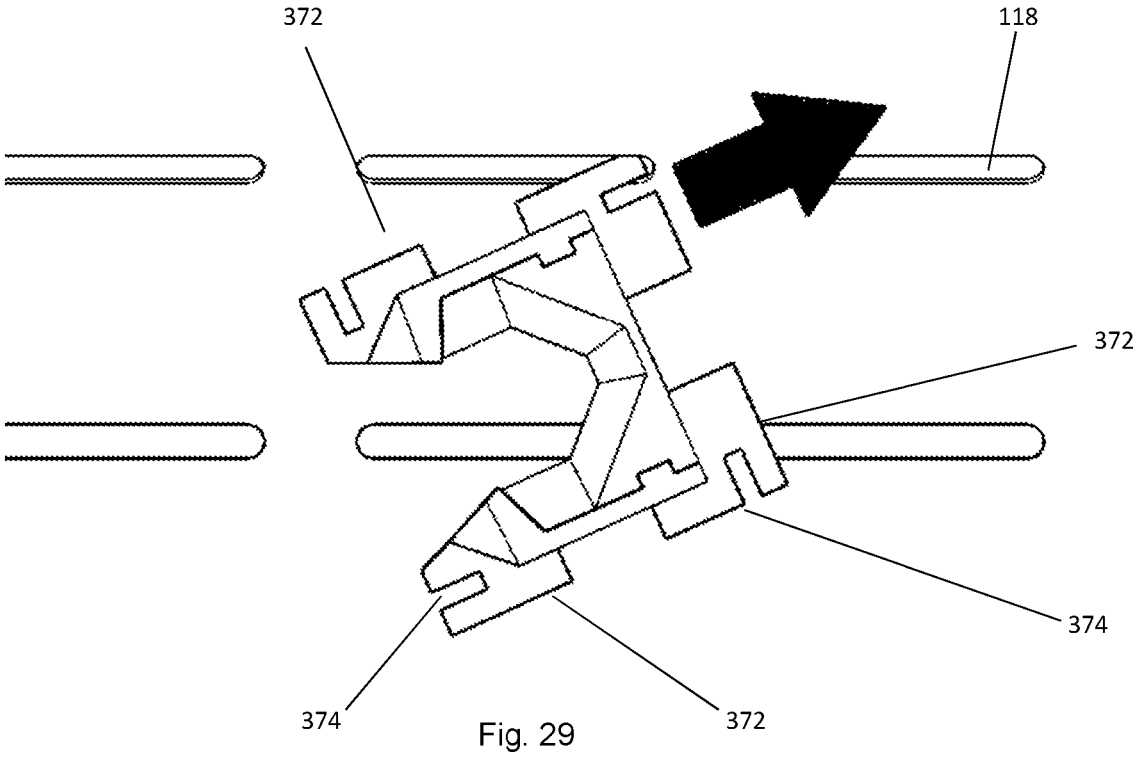
Figure 30:
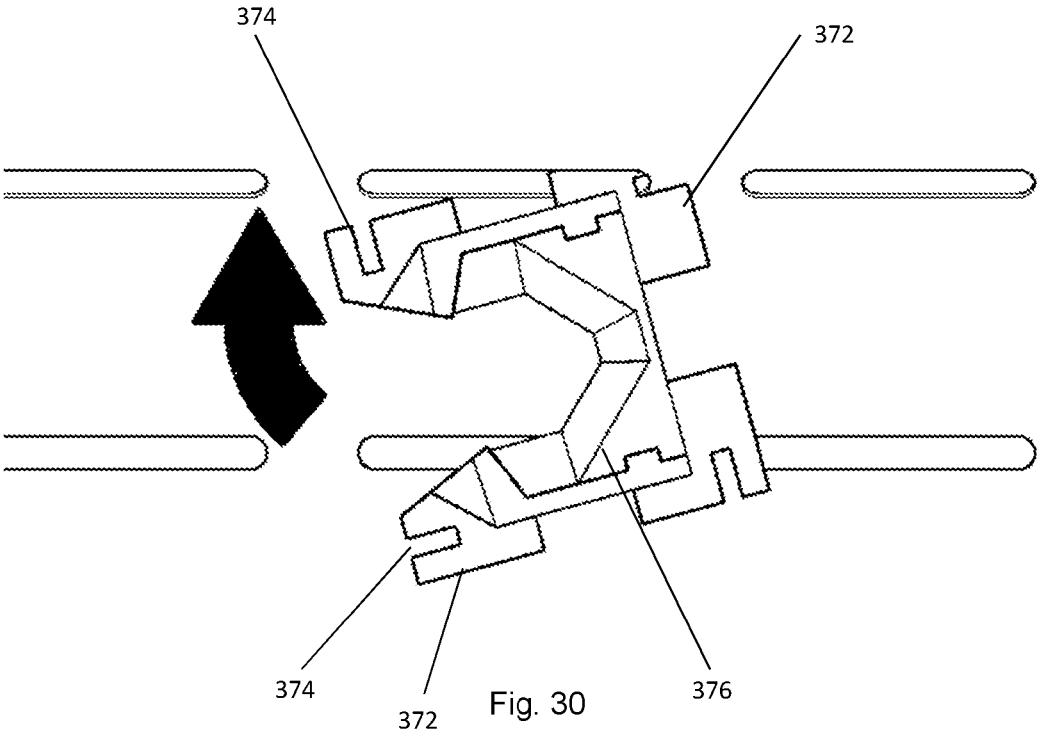
Figure 31:
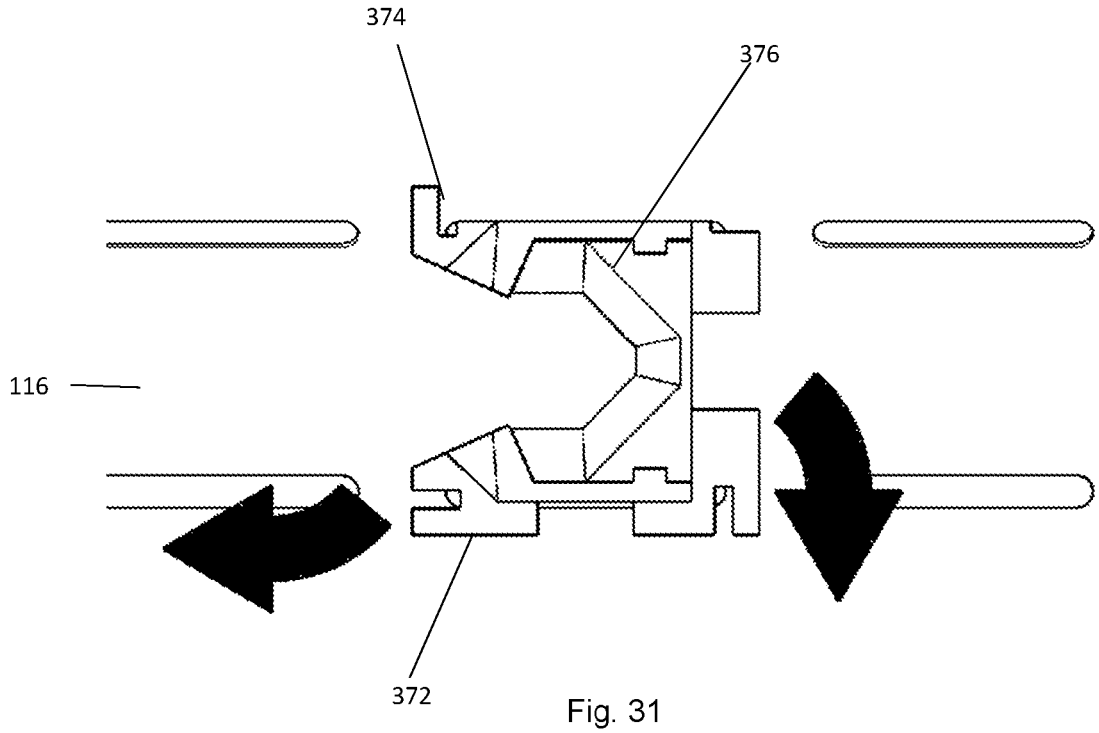
Figure 32:
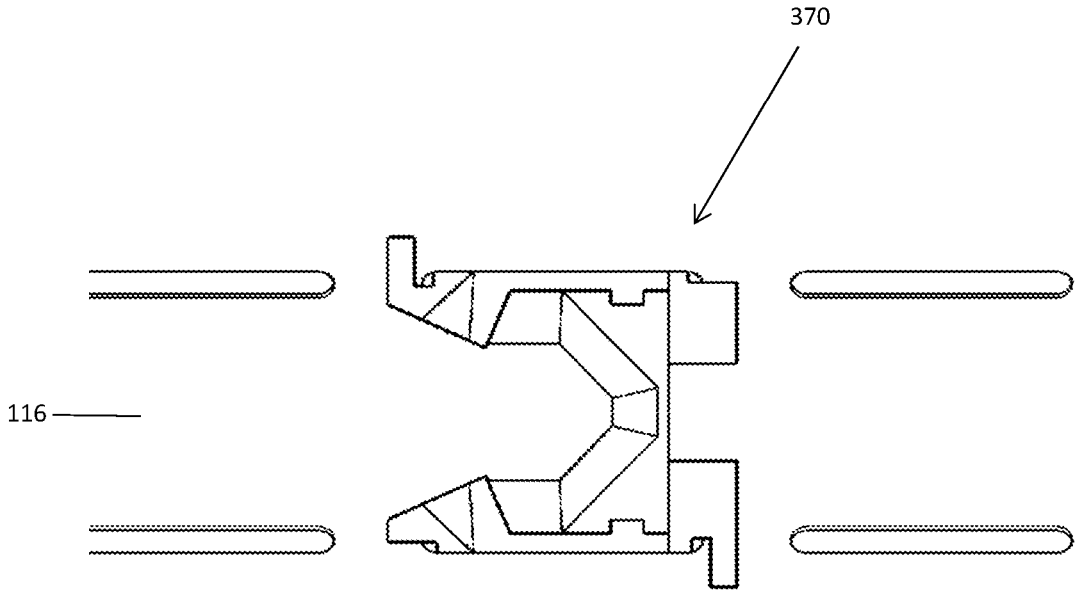

With reference to FIGS. 24-26, it can be seen that the tool 350 can be fitted underneath a MOLLE loop 116 and it has the effect of folding the tabs 312 out of the way, enabling the connector 300 to be slid through a MOLLE loop 116 without the tabs 312 impeding the sliding motion of the connector 310 through the loops 116.

Figure 33:
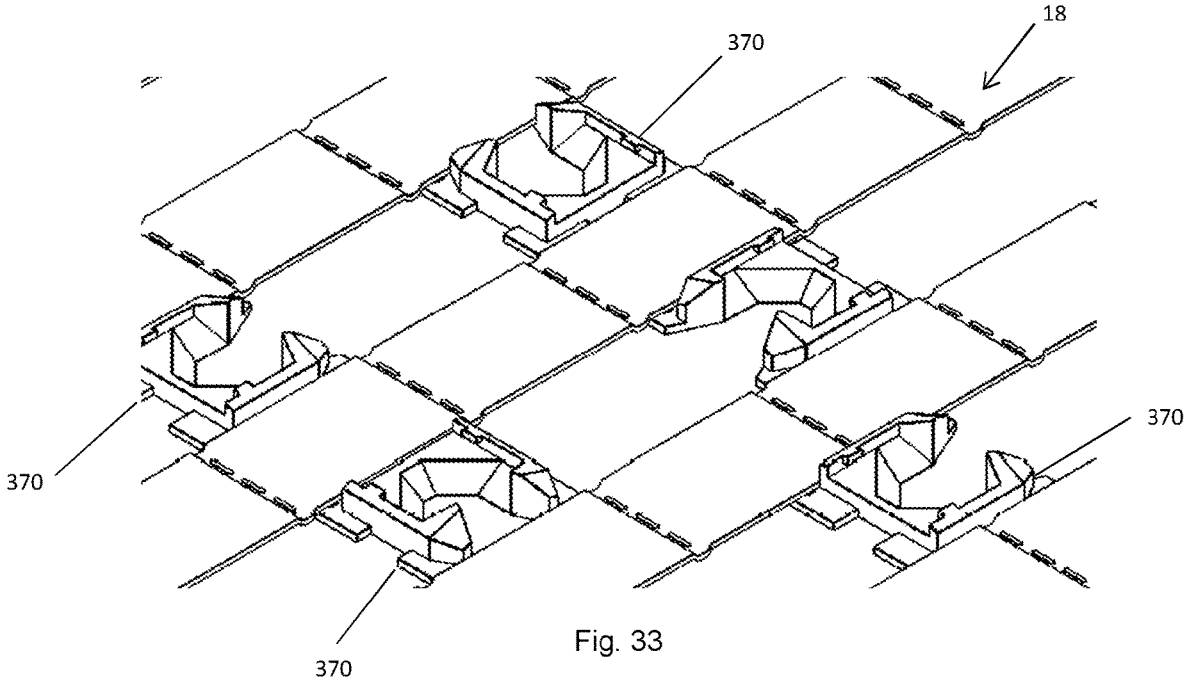

With reference to FIGS. 27-33, these show a fixation element 370 that can be used for fixing the end of the connector 300 to MOLLE webbing. The fixation element 370 includes, in this embodiment, four feet 372 having slots 374 therein which are orthogonally arranged with respect to one another, as will be apparent in particular from FIGS. 29 and 30. The feet and connector and sized to be able to fit within the slots 118 of MOLLE webbing in the manner shown. They include a fitting 376 to which, in this example, the coupling element 320 can be attached. A plurality of the fixation elements could be fitted to MOLLE webbing, as shown in FIG. 33, for example. As will be apparent from FIG. 33, the fixation elements 370 are preferably designed with rotational symmetry, such that they can be attached to the MOLLE webbing 18 in four differing orientations, allowing four directions of insertion for the coupling element 320.

Figure 34:
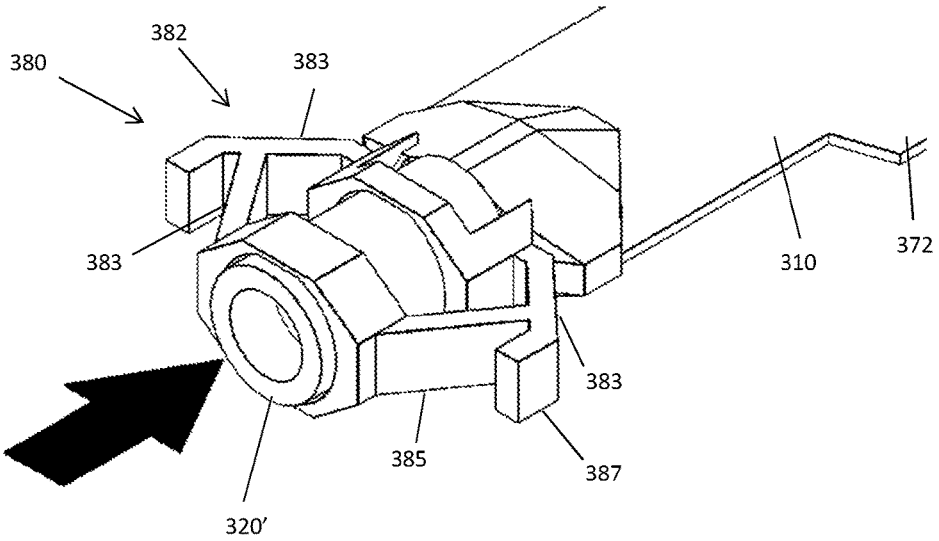
FIGS. 34-36 show an arrangement of male and female coupling elements for use with a connector as taught herein.
Figure 35:
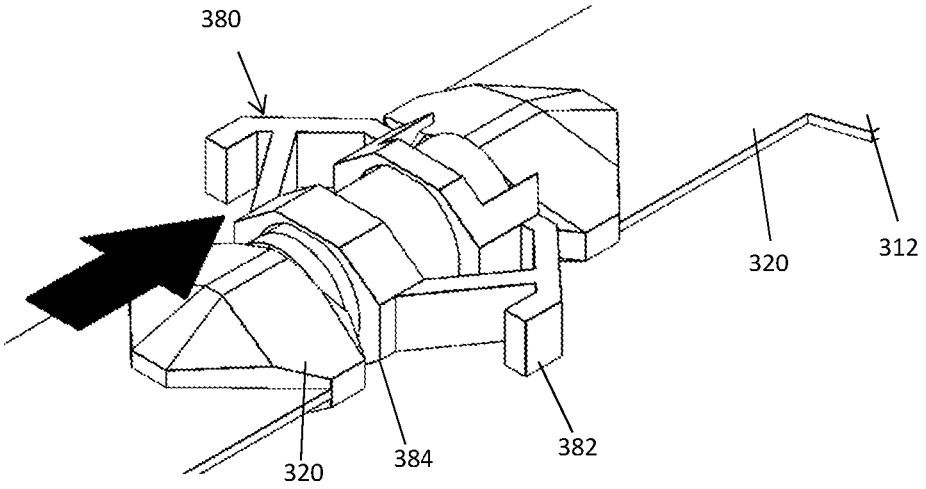
Figure 36:
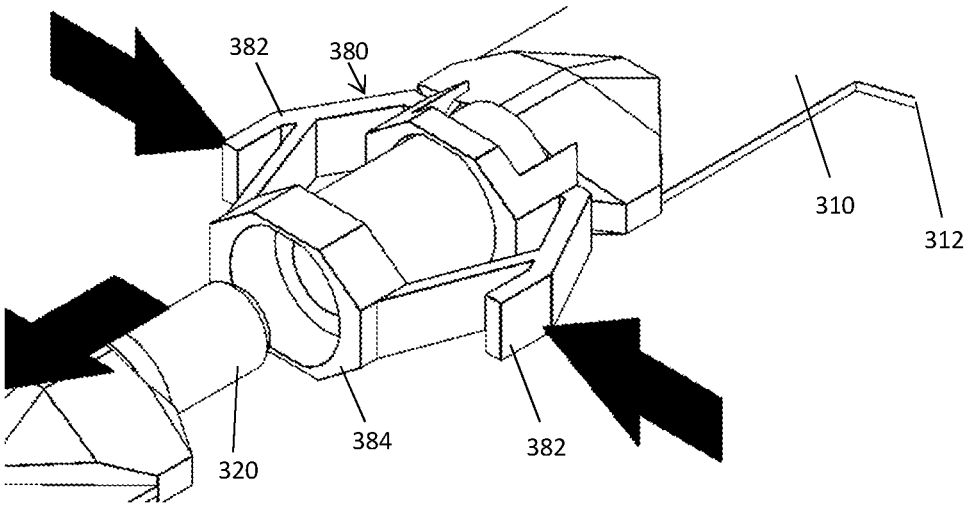

With reference to FIGS. 34-36, these show an embodiment of male and female coupling elements for use with the elongate connector elements. It will be appreciated that the coupling elements 320, 320' are used with connector elements having a channel therein for the passage of a wire, cable or other component. In this example, the male and female coupling elements are a tight fit one into the other. In order to separate them there is provided a push element 380 having side arms 382 and a push shoulder or ring 384, which extends forwardly when the arms 382 are pressed together, such that the push shoulder or ring 384 pushes the male coupling element away in order to detach it from the female coupling element. This provides for rapid coupling and uncoupling of elements to one another. More specifically, each side arm 382 is formed, in the embodiment shown, of two connected struts 383, 385 that extend laterally, typically diametrically, outwardly from the main body of the pusher 380 and coupling element 320' and have a finger grip 387 at their widest point. The struts 383, 385 are able to pivot or flex when the grips 387 are pressed together, causing an elongation in the longitudinal direction, which moves the push shoulder 384 forwardly. The arms 382 are preferably resilient so that they spring back to the position shown in FIGS. 34 and 35, although in other embodiments they may be pushed back to this position on insertion of the coupling element 320, which can drive the push shoulder or ring 384 backwardly in the absence of any force on the finger grips 387.

Figure 37:
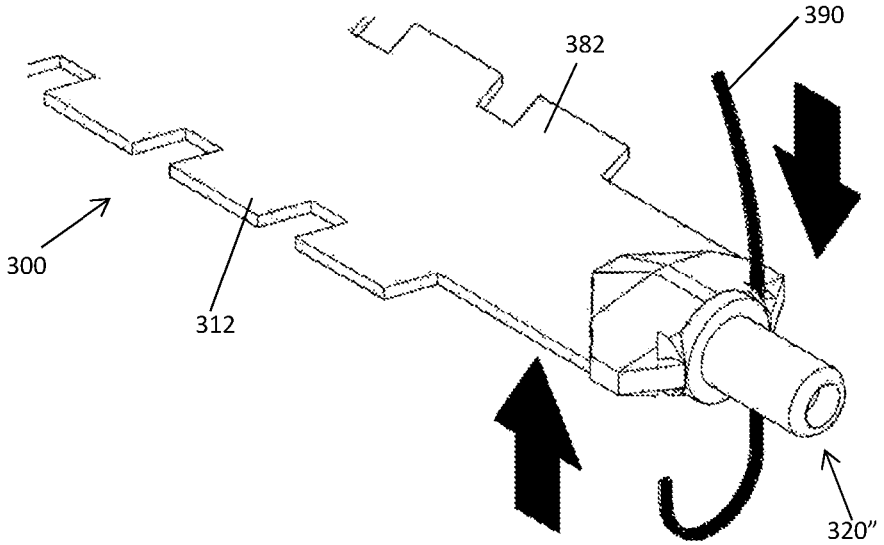
FIGS. 37 and 38 show an embodiment of coupling element able to be attached to a lanyard for manipulation.
Figure 38:
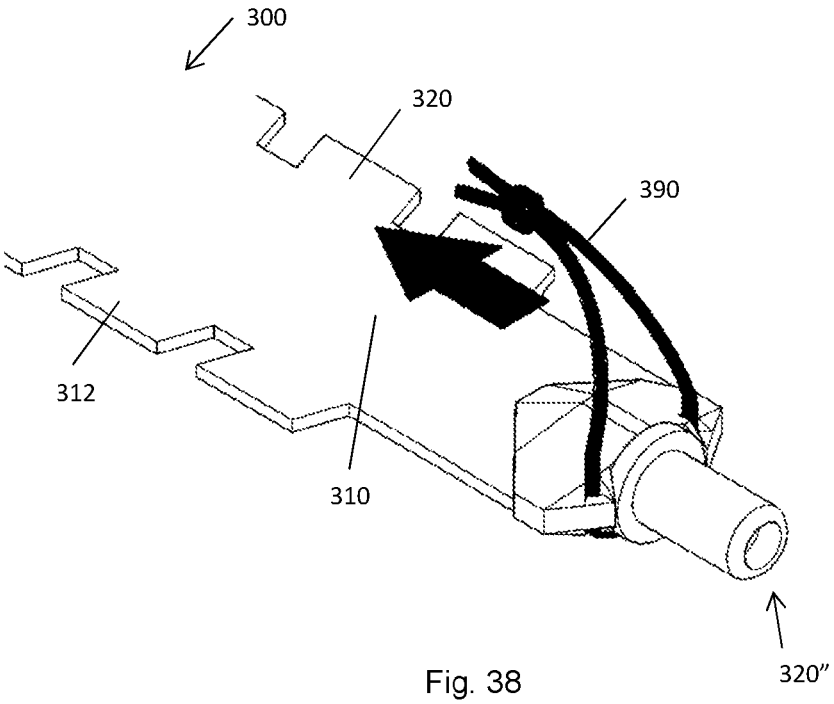

With reference to FIGS. 37 and 38, in this embodiment, the coupling element 320" may be provided with slots through which a lanyard 390 can be fed for use in manipulating the coupling elements 320" and as a result the end of the connector 300.

Figure 39:
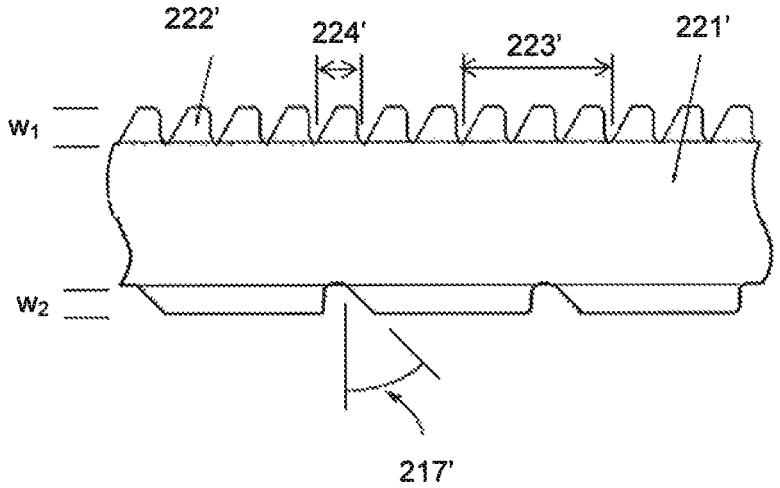
FIG. 39 shows another embodiment of flexible strip in accordance with the invention.

FIG. 39 shows another embodiment of flexible strip 221' according to the teachings herein. The strip has tabs 222' of different longitudinal lengths and of different lateral widths w1 and w2. The strip 221' can have all the other characteristics disclosed herein.

It will be appreciated that the characteristics shown in FIGS. 11-14, the coupling element shown in FIGS. 15 and 38, the tool of FIGS. 21-26 and the fixation element of FIGS. 27-33 could be used with any of the embodiments disclosed herein as appropriate thereto.

In all of the preferred embodiments, it may be advantageous for the surface finish of the strip or cable to match the surface finish of the garment to which attachment is sought, in order to minimise the visual impact of the strip or cable, and/or reduce its visible and/or infrared detection signature. For example, the strip or cable may be provided with an outer surface that is printed, dyed, painted, or laminated to match the garment's printed or dyed colour or camouflage pattern. Alternatively, the strip may be provided with an outer surface that is composed of the same textile material as the garment.

Alternatively, or in conjunction with these aforementioned finishes, the strip or cable may be provided with a composition and/or surface finish that serves to better radiate, conduct or convect away heat generated by the cable, in order to reduce its infrared or thermal detection signature. The surface might, for example, comprise a heavily textured or finned surface, whilst the composition might, for example, be of a highly thermally conductive material.

It should be evident that if an embodiment of the invention is attached permanently to a terminating electrical connector or connectors at one or both ends, then one or both of those electrical connectors is preferably sufficiently small in transverse cross-section to pass through a MOLLE loop in order to route the cable in a vertical orientation. That is, one or both of the electrical connectors preferably has a circumference of less than 75 mm or 3". Advantageously, the circumference of the electrical connector(s) is less than 50 mm or 2", to pass through a laser-cut MOLLE slot.

The invention claimed is:

1. A connector for connection to MOLLE webbing, the MOLLE webbing having a plurality of MOLLE loops, the connector including an elongate flexible strip having opposing elongated sides extending between opposing ends, and first and second arrays of tabs, each array extending from a respective side of the elongate flexible strip with the tabs of each array being spaced along the length of the side, wherein the arrays are arranged in laterally opposing relationship relative to one another, the tabs being configured for coupling to MOLLE loops with the tabs retaining their laterally opposing relationship relative to one another, thereby to attach the connector to MOLLE webbing, the elongate flexible strip being foldable along the first and second arrays of tabs.

2. The connector of claim 1 wherein the strip is substantially flat.

3. The connector of claim 1 wherein the strip is substantially planar and the first and second arrays of tabs are substantially coplanar with the strip.

4. The connector of claim 1 wherein the strip has a longitudinal dimension and the first and second arrays of tabs are substantially aligned in the longitudinal dimension.

5. The connector of claim 1 wherein the tabs of the first and second arrays are of substantially the same length.

6. The connector of claim 1 wherein the tabs of the first and second arrays are of substantially the same lateral width.

7. The connector of claim 1 wherein the tabs of the first array are laterally wider than the tabs of the second array.

8. The connector of claim 1 wherein the tabs each include at least one slit between the tab and the strip.

9. The connector of claim 8 wherein each tab includes a first slit adjacent a first side of the tab and an opposite second slit adjacent an opposite second side of the tab.

10. The connector of claim 1 wherein the strip includes an internal channel configured to receive a cable, wire, tube or other component therein.

11. The connector of claim 10 wherein a component is releasably received in the internal channel or fixed to the strip in the internal channel.

12. The connector of claim 10 further including a coupling element disposed at one of the ends of the elongate strip, the coupling element providing access to the internal channel in the strip.

13. The connector of claim 10 further including a male coupling element disposed one of the ends of the strip and a female coupling element disposed at the other of the ends of the strip, the coupling elements providing access to the internal channel in the strip.

14. The connector of claim 12 including a fixation frame connectable between MOLLE loops and having a connector portion to which the coupling element is releasably attachable.

15. The connector of claim 14 wherein the fixation frame includes slotted feet configured to be coupled into associated MOLLE loops.

16. The connector of claim 15 wherein the slotted feet have slots disposed orthogonally to one another.

17. The connector of claim 12 further including a push element having first and second side arms and a push shoulder or ring attached to the side arms, the side arms including struts extending laterally outwardly relative to the push shoulder or ring and being compressible laterally, wherein lateral compression of the side arms causes the push shoulder or ring to be moved in a longitudinal direction.

18. The connector of claim 17 further including a second element coupled to the coupling element, wherein the push element is connected to the coupling element, wherein radial compression of the side arms causes the push shoulder or ring to push the second coupling element away from the coupling element in an uncoupling direction.

19. The connector of claim 1 wherein the tabs have a pitch of 1.25 to 3.8 centimetres.

20. The connector of claim 1 wherein the connector is sized to fit between rows of standard MOLLE webbing and/or sized to fit within columns of standard MOLLE webbing loops.

21. The connector of claim 1 further including an insertion tool having an interior configured to receive the strip with the tabs deflected by the tool, the tool being configured to be insertable in a MOLLE loop with the strip received within the tool, the tabs engaging with the MOLLE loop on removal of the tool.

22. The connector of claim 21 wherein the tool includes a base member and first and second upstanding flanges tapering towards one another from the base member, the flanges being configured to deflect the tabs towards one another when the strip is received into the tool.

23. The connector of claim 1 wherein the strip is substantially flat when folded.

24. A method of attaching a component to a substrate having MOLLE webbing using the connector of claim 1, the method including the steps of fitting the connector to the MOLLE webbing by disposing the tabs below one or more loops of the MOLLE webbing with the tabs retaining their laterally opposing relationship relative to one another, and disposing a component between the connector and the substrate, whereby the component is held by and covered by the connector.

25. The method of claim 24 including the steps of bending, curving or folding the strip of the connector and attaching the connector to at least one row and at least one column of the MOLLE webbing.

26. The method of claim 24 wherein the strip includes an internal channel configured to receive the component therein, and the component is disposed in the channel.

27. A connector for connection to MOLLE webbing, the MOLLE webbing having at least first and second rows of MOLLE loops, the connector including an elongate flexible strip having opposing elongated sides extending between opposing ends, and first and second arrays of tabs, each array extending from a respective side of the elongate flexible strip with the tabs of each array situated in series along the length of the side, wherein the arrays are arranged in laterally opposing relationship relative to one another, the tabs being configured for coupling to MOLLE loops with the tabs retaining their laterally opposing relationship relative to one another, thereby so as to attach the connector to MOLLE webbing with the connector at least partially disposed and attached between the first and second rows of MOLLE loops, the elongate flexible strip being foldable along the first and second arrays of tabs.

28. The connector of claim 27 wherein the strip is substantially flat.

29. The connector of claim 27 wherein the strip is substantially flat when folded.

30. The connector of claim 27 wherein the strip is substantially planar and the first and second arrays of tabs are substantially coplanar with the strip.

31. The connector of claim 27 wherein the strip has a longitudinal dimension and the first and second arrays of tabs are substantially aligned in the longitudinal dimension.

32. The connector of claim 27 wherein the tabs of the first and second arrays have substantially the same length as measured from the sides of the strip.

33. The connector of claim 27 wherein the tabs of the first and second arrays are of substantially the same lateral width as measured along the length of the strip.

34. The connector of claim 27 wherein the tabs of the first array are laterally wider than the tabs of the second array.

35. The connector of claim 27 wherein the tabs each include a slit between a base of the tab and the strip.

36. The connector of claim 35 wherein each tab includes a first slit adjacent a first side of the tab and an opposite second slit adjacent an opposite second side of the tab.

37. The connector of claim 27 wherein the strip includes an, internal channel configured to receive a cable, wire, tube or other elongated component therein.

38. The connector of claim 37 further including a male coupling element disposed at one of the ends of the strip and a female coupling element disposed at the other of the ends of the strip, the coupling elements providing access to the internal channel in the strip, the coupling elements further being configured for connection to each other.

39. The connector of claim 38 wherein an elongated component is situated within the internal channel.

40. The connector of claim 38 further including a coupling element disposed at one of the ends of the elongate strip, the coupling element providing access to the internal channel in the strip.

41. The connector of claim 40 further including a fixation frame connectable between MOLLE loops and having a connector portion configured for releasable attachment to the coupling element.

42. The connector of claim 41 wherein the fixation frame includes slotted feet configured to be coupled into corresponding MOLLE loops.

43. The connector of claim 42 wherein the slotted feet include slots oriented orthogonally to one another.

44. The connector of claim 27 wherein the tabs have a pitch of 1.25 to 3.8 centimeters.

45. The connector of claim 27 wherein the connector is sized to fit between rows of standard MOLLE webbing and/or sized to fit within columns of standard MOLLE webbing loops.

46. The connector of claim 27 further including an insertion tool having an interior configured to receive the strip with the tabs deflected by the tool, the tool being configured to be insertable in a MOLLE loop with the strip received within the tool, the tabs engaging with the MOLLE loop on removal of the tool.

47. The connector of claim 18 wherein the tool includes a base member and first and second flanges extending from the base member and towards one another, the flanges being configured to deflect the tabs towards one another when the strip is received into the tool.

48. A connector for connection to MOLLE webbing, the connector including a substantially flat body portion having opposing elongated sides extending between opposing ends; first and second tabs extending laterally from respective sides of the body portion in opposing directions, the tabs having a length between 1.25 and 3.8 centimeters; and a tie or coupling attached to the body portion and extending in a plane orthogonal to the plane of the body portion, the tie or coupling being spaced from the ends of the body portion.

49. A ribbon-like cable in the form of a connector for connection to MOLLE webbing having a plurality of MOLLE loops, the connector including a flexible strip having elongated strip sides extending between opposing strip ends, each strip side having tabs extending therefrom and arrayed along the length of the strip side, whereby the tabs of each strip side are situated laterally opposite the tabs of the other strip side, the tabs being configured for coupling to MOLLE loops with the tabs retaining their laterally opposite relationship relative to one another to thereby attach the connector to MOLLE webbing, the strip being foldable along the first and second arrays of tabs.

* * * * *